US007712887B2

(12) United States Patent
Kadomatsu et al.

(10) Patent No.: US 7,712,887 B2
(45) Date of Patent: May 11, 2010

(54) IMAGE FORMING APPARATUS

(75) Inventors: Tetsuzo Kadomatsu, Kanagawa (JP); Masaaki Konno, Kanagawa (JP); Toshiyuki Makuta, Fujinomiya (JP)

(73) Assignee: Fujifilm Corporation, Tokyo (JP)

( * ) Notice: Subject to any disclaimer, the term of this patent is extended or adjusted under 35 U.S.C. 154(b) by 658 days.

(21) Appl. No.: 11/493,635

(22) Filed: Jul. 27, 2006

(65) Prior Publication Data

US 2007/0024686 A1 Feb. 1, 2007

(30) Foreign Application Priority Data

Jul. 29, 2005 (JP) ..... 2005-220918

(51) Int. Cl.
*B41J 2/01* (2006.01)

(52) U.S. Cl. ..... 347/102; 347/101

(58) Field of Classification Search ..... 347/101, 347/102, 103, 100, 95, 96
See application file for complete search history.

(56) References Cited

U.S. PATENT DOCUMENTS

| | | | | |
|---|---|---|---|---|
| 4,630,076 | A * | 12/1986 | Yoshimura | 347/43 |
| 6,350,022 | B1 | 2/2002 | Takemura et al. | |
| 7,185,980 | B2 * | 3/2007 | Kumamoto et al. | 347/102 |
| 2003/0234848 | A1 * | 12/2003 | Ishikawa | 347/102 |
| 2004/0189772 | A1 * | 9/2004 | Arai | 347/102 |
| 2005/0099478 | A1 * | 5/2005 | Iwase | 347/102 |
| 2005/0190248 | A1 * | 9/2005 | Konno et al. | 347/102 |
| 2008/0192100 | A1 * | 8/2008 | Nakajima | 347/102 |

FOREIGN PATENT DOCUMENTS

| | | | |
|---|---|---|---|
| JP | 60-132767 | A | 7/1985 |
| JP | 8-72234 | A | 3/1996 |
| JP | 2003-127517 | A | 5/2003 |

* cited by examiner

*Primary Examiner*—Manish S Shah
(74) *Attorney, Agent, or Firm*—Birch, Stewart, Kolasch & Birch, LLP

(57) ABSTRACT

The image forming apparatus includes: a first liquid ejection device which, while scanning to and fro in a direction substantially orthogonal to a conveyance direction of a recording medium, ejects a first liquid containing a coloring material onto the recording medium; second liquid ejection devices which are disposed respectively on both regions in a scanning direction outside the first liquid ejection device, the second liquid ejection devices ejecting a second liquid onto at least an area of the recording medium on which the first liquid is to be deposited prior to the first liquid being deposited while the second liquid ejection devices perform a scan together with the first liquid ejection device; and first radiation irradiating devices which are disposed respectively on both regions in the scanning direction outside the first liquid ejection device, the first radiation irradiating devices irradiating an area of the recording medium on which the first liquid and the second liquid have been deposited with a radiation while the first radiation irradiating devices perform a scan together with the first liquid ejection device, wherein at least one of the first liquid and the second liquid contains a radiation-curable polymerizable compound; and at least one of the first liquid and the second liquid contains a polymerization initiator.

9 Claims, 7 Drawing Sheets

IMAGE FORMING APPARATUS

BACKGROUND OF THE INVENTION

1. Field of the Invention

The present invention relates to an image forming apparatus, and in particular, relates to an image forming apparatus that fixes a coloring material-containing ink on a medium through reaction between the ink and a treatment liquid, so as to form a desired image on the medium.

2. Description of the Related Art

In recent years, inkjet recording apparatuses have become widespread as image forming apparatuses for forming images such as pictures and documents on media. An inkjet recording apparatus forms a desired image on a medium by ejecting ink droplets onto the medium from nozzles in heads while moving the heads relatively to the recording medium.

Depending on the type of the medium and the types of the inks, a phenomenon of deposition interference may occur in which an ejected ink droplet overlaps (contacts) at least part of another ink droplet already on the medium, whereby the ink droplets become mixed together. Moreover, if the deposited ink penetrates into the medium, then smearing or spreading out of the dots formed may occur. To prevent image degradation due to such deposition interference and so on, an inkjet recording apparatus has been. proposed according to which ink and a treatment liquid that can react with the ink are deposited onto a medium, and the ink and the treatment liquid are made to react with one another on the medium, whereby deposition interference of the ink, and the like, are prevented (see, for example, Japanese Patent Application Publication No. 8-72234).

Moreover, an inkjet recording apparatus has been proposed in which an ultraviolet radiation-curable ink is used. After the ink has been deposited onto a medium, the ultraviolet radiation-curable ink is irradiated with ultraviolet radiation, whereby the ink is cured and fixed (see, for example, Japanese Patent Application Publication No. 60-132767, and Japanese Patent Application Publication No. 2003-127517).

However, with a system in question two liquids, i.e. an ink and a treatment liquid, are mixed together, as described in Japanese Patent Application Publication No. 8-72234, if the mixing between the two liquids is insufficient or the balance between the two liquids is poor in places, then the curing of the mixture of the two liquids may be insufficient, and hence there is a possibility that the ink is not fixed on the medium.

Moreover, with a system in which an ultraviolet radiation-curable ink is used, as described in Japanese Patent Application Publication No. 60-132767 or Japanese Patent Application Publication No. 2003-127517, there is a possibility that deposition interference of the ink, or the like, may occur before the irradiation of the ultraviolet radiation is carried out, resulting in degradation of the image quality.

SUMMARY OF THE INVENTION

In view of the above circumstances, it is an object of the present invention to provide an image forming apparatus according to which ink deposited onto a recording medium can be reliably cured and fixed while deposition interference is prevented so that a desirable image can be formed.

In order to attain the aforementioned object, the present invention is directed to an image forming apparatus comprising: a first liquid ejection device which, while scanning to and fro in a direction substantially orthogonal to a conveyance direction of a recording medium, ejects a first liquid containing a coloring material onto the recording medium; second liquid ejection devices which are disposed respectively on both regions in a scanning direction outside the first liquid ejection device, the second liquid ejection devices ejecting a second liquid onto at least an area of the recording medium on which the first liquid is to be deposited prior to the first liquid being deposited while the second liquid ejection devices perform a scan together with the first liquid ejection device; and first radiation irradiating devices which are disposed respectively on both regions in the scanning direction outside the first liquid ejection device, the first radiation irradiating devices irradiating an area of the recording medium on which the first liquid and the second liquid have been deposited with a radiation while the first radiation irradiating devices perform a scan together with the first liquid ejection device, wherein at least one of the first liquid and the second liquid contains a radiation-curable polymerizable compound; and at least one of the first liquid and the second liquid contains a polymerization initiator.

According to this aspect of the present invention, in each of the scanning directions, the second liquid is ejected prior to the first liquid, whereby deposition interference is prevented. Moreover, irradiation of radiation is carried out immediately after the ejection of the first liquid, whereby the first liquid is cured and fixed promptly. As a result, a high-quality image can be obtained.

Radiation-curable polymerizable (polymerization) compounds that can be used can include substances which are polymerized upon being mixed with the polymerization initiator and then radicals being generated from the polymerization initiator through the irradiation of the radiation, and examples include radiation-curable polymers, radiation-curable oligomers (prepolymers), and mixtures thereof. Moreover, the radiation referred to here may be ultraviolet radiation, an electron beam, or other radiation.

The recording medium is a medium onto which the first and second liquids ejected from the first and second liquid ejection devices are deposited, and examples include continuous paper, cut paper, sealing paper, a resin sheet such as a PHP sheet, a film, a cloth, and any of various other media with no limitation on material or form.

Preferably, the second liquid contains a diffusion preventing agent for preventing diffusion and smearing of the first liquid.

According to this aspect of the present invention, an image can be fixed in a state in which diffusion and smearing of the first liquid deposited on the recording medium has been prevented.

Preferably, the first liquid contains the radiation-curable polymerizable compound and does not contain the polymerization initiator; and the second liquid contains the polymerization initiator and does not contain the radiation-curable polymerizable compound.

Preferably, the first liquid contains the polymerization initiator and does not contain the radiation-curable polymerizable compound; and the second liquid contains the radiation-curable polymerizable compound and does not contain the polymerization initiator.

According to these aspects of the present invention, an ejection defect caused by curing of the radiation-curable polymerizable compound in the first liquid ejection device or the second liquid ejection devices, due to leaked radiation or reflected radiation, can be prevented.

Preferably, the second liquid contains the radiation-curable polymerizable compound and the polymerization initiator.

According to this aspect of the present invention, even in the case where the second liquid is deposited over a larger area than that over which the first liquid is deposited so as to prevent image disturbance, all of the second liquid can be cured.

Preferably, the second liquid ejection devices are disposed between the first liquid ejection device and the first radiation irradiating devices.

According to this aspect of the present invention, the time from the second liquid being deposited to the first liquid being deposited can be shortened. In this aspect, a recording medium through which the second liquid can readily permeate, can be suitably used.

Preferably, the first radiation irradiating devices are disposed between the first liquid ejection device and the second liquid ejection devices.

According to this aspect of the present invention, the distance between the first liquid ejection device and each of the second liquid ejection devices can be adjusted, and hence the time from the second liquid being deposited to the first liquid being deposited can be controlled. In this aspect, a plurality of recording media having different permeabilities, can be suitably used.

Preferably, the image forming apparatus further comprises a second radiation irradiating device which is disposed after the first liquid ejection device in the conveyance direction of the recording medium, the second radiation irradiating device performing irradiation of a radiation over a length corresponding to a width of the recording medium.

According to this aspect of the present invention, the first liquid and the second liquid can be reliably cured and fixed on the recording medium.

Preferably, wavelength distribution of the radiation by the first radiation irradiating devices is different from wavelength distribution of the radiation by the second radiation irradiating device.

According to this aspect of the present invention, the first liquid and the second liquid can be cured efficiently on the recording medium.

Preferably, a peak wavelength of the radiation by the first radiation irradiating devices is shorter than a peak wavelength of the radiation by the second radiation irradiating device.

According to this aspect of the present invention, the surface of the first liquid can be instantly cured by the first radiation irradiating devices so as to fix the image, and then the interior of the first liquid can be reliably cured by the second radiation irradiating device.

According to the present invention, with respect to each of the scanning directions, the second liquid is ejected prior to the first liquid, whereby deposition interference can be prevented, and moreover irradiation of radiation is carried out immediately after the ejection of the first liquid, whereby the first liquid is cured and fixed promptly. As a result, a high-quality image can be obtained.

BRIEF DESCRIPTION OF THE DRAWINGS

The nature of this invention, as well as other objects and advantages thereof, are explained in the following with reference to the accompanying drawings, in which like reference characters designate the same or similar parts throughout the figures and wherein.

DETAILED DESCRIPTION OF THE PREFERRED EMBODIMENTS

Configuration of Inkjet Recording Apparatus

Figure 1:
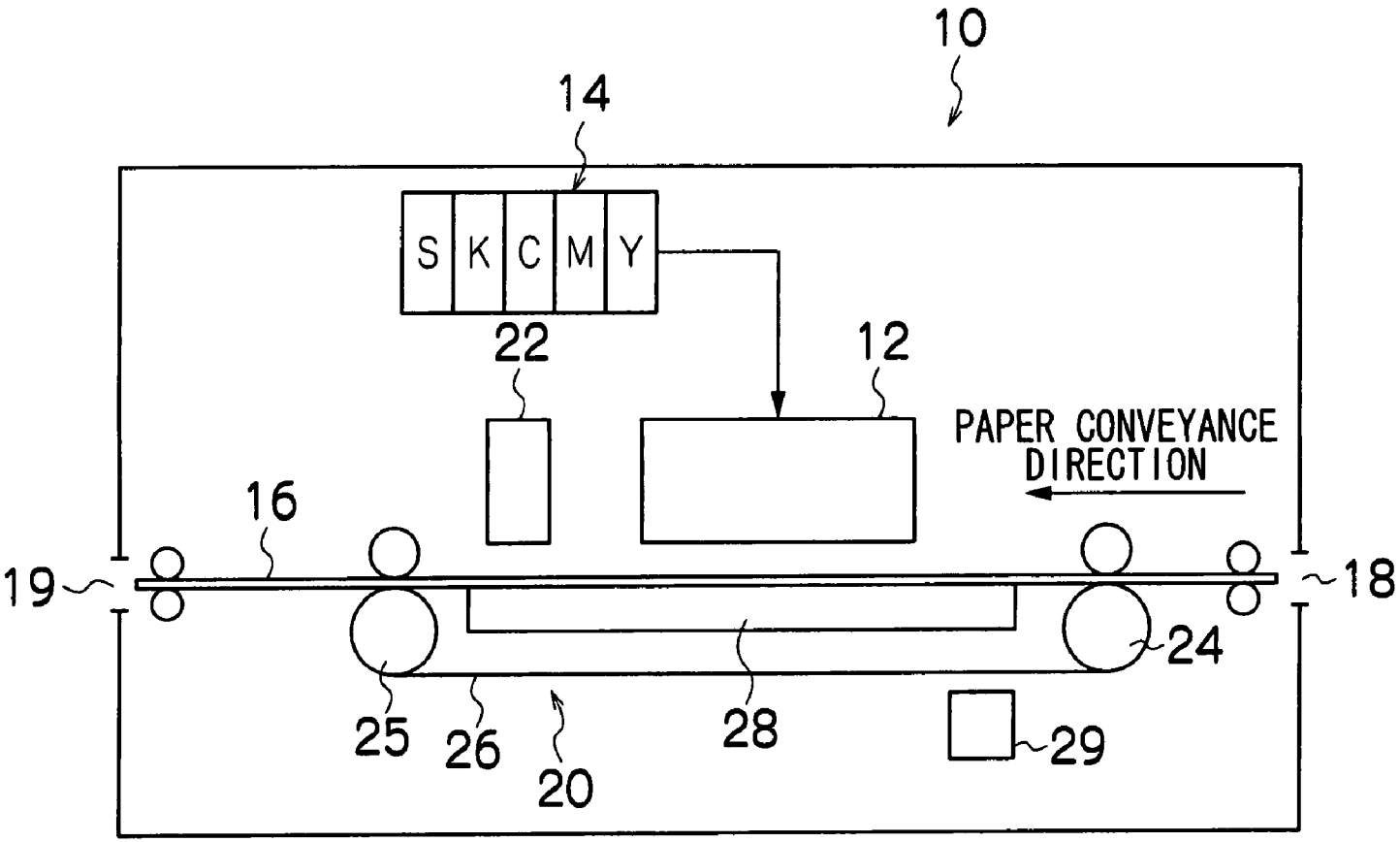
FIG. 1 is a general schematic drawing of an inkjet recording apparatus according to a first embodiment.

FIG. 1 is a general schematic drawing of an inkjet recording apparatus according to an embodiment of the present invention. The inkjet recording apparatus 10 shown in the present embodiment is a two-liquid type inkjet recording apparatus in which a treatment liquid and a colored ink(s) that has been deposited on a recording medium are irradiated with ultraviolet radiation (UV) so as to bring about polymerization.

As shown in FIG. 1, the inkjet recording apparatus 10 comprises: a print unit 12; a liquid storing/loading unit 14 that stores inks of various colors (K, C, M, Y) and a treatment liquid (S) to be supplied to the print unit 12; a paper supply unit 18 that supplies recording paper 16; a discharge unit 19 that discharges the recording paper after recording (the printed article) to the outside; a conveyance unit 20 that is disposed facing an ejection surface of the print unit 12 and conveys the recording paper 16 while maintaining the flatness of the recording paper 16; and a print determination unit 22 that reads the results of the printing by the print unit 12.

The paper supply unit 18 is provided with, for example, a paper roll (continuous paper) magazine. A plurality of magazines with different paper widths, paper qualities or the like may be provided together. Moreover, instead of a paper roll magazine, or used together therewith, paper may be supplied by a cassette in which sheets of cut paper are loaded and stacked on one another.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The conveyance unit 20 has a structure in which an endless belt 26 is set around rollers 24 and 25, and is configured such that at least a portion facing the ejection surface of the print unit 12 and a sensor surface of the print determination unit 22 is flat.

The belt 26 has a width that is greater than the width of the recording paper 16, and a large number of suction holes (not shown) are formed in the belt surface. A suction chamber 28 is provided in a position facing the ejection surface of the print unit 12 and the sensor surface of the print determination unit 22 on the interior side of the belt 26, which is set around the rollers 24 and 25. A negative pressure is generated by sucking out from the suction chamber 28 using a fan (not shown), whereby the recording paper 16 is held on the belt 26 by suction. Power from a motor (not shown) is transmitted to at least one of the rollers 24 and 25 around which the belt 26 is set, whereby the belt 26 is driven in a counterclockwise direction in FIG. 1, so that the recording paper 16 held on the belt 26 is conveyed from the right to the left in FIG. 1.

Since ink adheres to the belt 26 when a marginless print job or the like is performed, a belt-cleaning unit 29 is disposed in a predetermined position (a suitable position outside the printing area) on the exterior side of the belt 26. Although the details of the configuration of the belt-cleaning unit 29 are not shown, examples thereof include a configuration in which the belt 26 is nipped with cleaning rollers such as a brush roller and a water absorbent roller, an air blow configuration in which clean air is blown onto the belt 26, or a combination of these. In the case of the configuration in which the belt 26 is nipped with the cleaning rollers, it is preferable to make the line velocity of the cleaning rollers different than that of the belt 26 to improve the cleaning effect.

The inkjet recording apparatus 10 can comprise a roller nip conveyance mechanism in which the recording paper 16 is pinched and conveyed with nip rollers, instead of the conveyance unit 20. However, there is a possibility in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

Although the configuration of the print unit 12 is described in detail later, the print unit 12 is configured so as to be movable to and fro in a paper width direction of the recording paper 16 (the direction (main scanning direction) orthogonal to the paper conveyance direction (sub-scanning direction)), and includes a plurality of ejection heads that eject respectively the inks of the various colors black (K), cyan (C), magenta (M) and yellow (Y), and the treatment liquid (S), and a plurality of light sources for UV (i.e., ultraviolet) irradiation.

The liquid storing/loading unit 14 has tanks in which the various colored inks (K, C, M, Y) and the treatment liquid (S) ejected by the print unit 12 are stored respectively. Each tank is communicated to each ejection head of the print unit 12 via a pipeline (not shown). Moreover, the liquid storing/loading unit 14 has a notification device (display device, warning alarm generating device, etc.) that notifies if the amount remaining of a liquid becomes low, and also has a mechanism to prevent the liquids from being confused with one another when being loaded.

The print determination unit 22 is configured with a line sensor having rows of photoelectric transducing elements with a width that is greater than the scanning range (image recording width) of the print heads 12. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally. The print determination unit 22 uses the line sensor to read the results of the droplet deposition by the print unit 12, and evaluates the ejection (determines whether or not the ejection has taken place, measures the dot size, measures the dot landing position, etc.), and thus acts as a device for checking for nozzle clogging or other ejection defects in the print unit 12.

Through this configuration, treatment liquid ejection, ink ejection, and UV irradiation are carried out in a predetermined order by the print unit 12 while the recording paper 16 supplied into the conveyance unit 20 from the paper supply unit 18 is conveyed in the paper conveyance direction and while the print unit 12 performs scans to and fro in the paper width direction of the recording paper 16 (the main scanning direction), whereby a desired color image is formed on the recording paper 16. The recording paper 16 is then discharged from the discharge unit 19.

Note that in the present example, a KCMY standard color (four-color) configuration has been described, but with regard to the ink colors and the number and combination thereof, there is no limitation to the present embodiment. Rather, light inks and dark inks may be added as required. For example, a configuration in which light inks such as light cyan and light magenta are ejected is possible.

Figure 2:
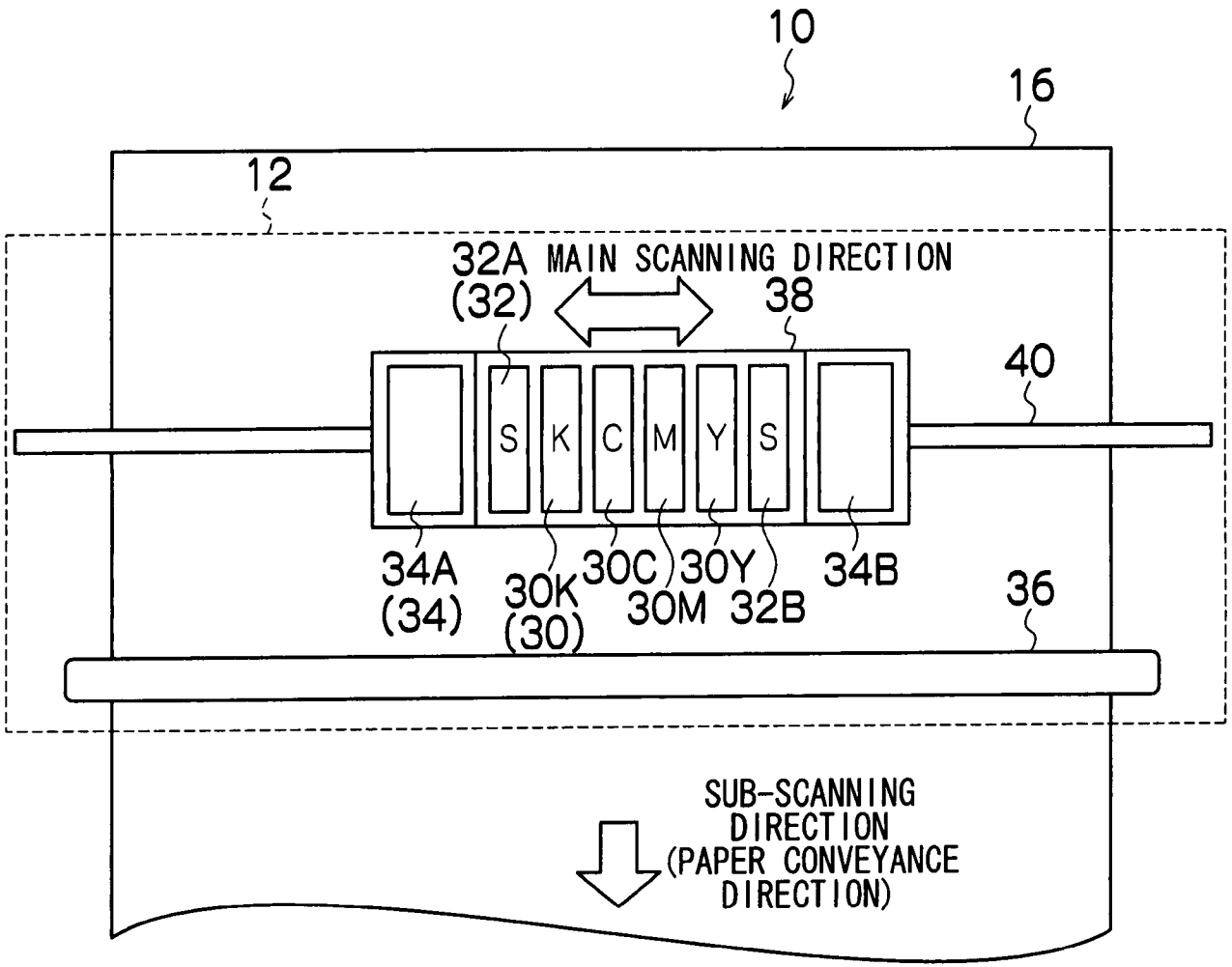
FIG. 2 is a plan view of principal components of the inkjet recording apparatus.

FIG. 2 is a plan view of principal components of the inkjet recording apparatus 10, showing a region around the print unit 12. The print unit 12 has a configuration including: ink ejection heads 30 (30K, 30C, 30M, 30Y) that eject the inks of the various colors, namely, black (K), cyan (C), magenta (M), and yellow (Y); treatment liquid ejection heads 32 (32A, 32B) that eject the treatment liquid (S); preliminary curing light sources 34 (34A, 34B) that irradiate an area of the recording paper 16 onto which the ink ejection heads 30 and the treatment liquid ejection heads 32 have deposited droplets with UV (ultraviolet radiation), in order to carry out preliminary curing of the colored inks; a main curing light source 36 that irradiates the whole width of the recording paper 16 with UV so as to completely cure the colored inks (fix the colored inks to the recording paper 16); and a carriage 38 that is configured so as to be movable to and fro along a guide rail 40 that extends in the paper width direction of the recording paper 16 (the direction (main scanning direction) orthogonal to the paper conveyance direction (sub-scanning direction)). In the following, the ink ejection heads and the treatment liquid ejection heads are sometimes referred to merely as "ejection heads".

The carriage 38 is a frame that holds the ink ejection heads 30 (30K, 30C, 30M, 30Y), the treatment liquid ejection heads 32 (32A, 32B), and the preliminary curing light sources 34 (34A, 34B).

The ink ejection heads 30 (30K, 30C, 30M, 30Y), the treatment liquid ejection heads 32 (32A, 32B), and the preliminary curing light sources 34 (34A, 34B) are mounted on the carriage 38 in a state arranged in a predetermined order in the main scanning direction. The order of arrangement of these components (30, 32, 34) is as follows. The ink ejection heads 30 (30K, 30C, 30M, 30Y) are disposed in a central region of the carriage 38. There are no particular limitations on the order of the ink ejection heads 30K, 30C, 30M, and 30Y. The treatment liquid ejection heads 32 (32A, 32B) are disposed on both sides on the outside of the ink ejection heads 30, respectively. The preliminary curing light sources 34 (34A, 34B) are disposed on both sides on the outside of the treatment liquid ejection heads 32, respectively. The ink ejection heads 30, treatment liquid ejection heads 32, and preliminary curing light sources 34 mounted in this order are integrated with the carriage 38 and thus move (scan) to and fro in the main scanning direction in an integrated fashion.

The ink ejection heads 30 (30K, 30C, 30M, 30Y) and the treatment liquid ejection heads 32 (32A, 32B) have the same configuration as one another, each being a short head having a large number of nozzles (not shown in FIG. 2, shown by reference numeral 51 in FIG. 3) from which the corresponding liquid (ink or treatment liquid) is ejected and which are formed in an ejection surface facing the recording paper 16. The configuration of the ink ejection heads 30 and the treatment liquid ejection heads 32 are described in detail later.

The compositions of the treatment liquid and the inks used in the inkjet recording apparatus 10 according to an embodiment of the present invention are described in detail later. The configuration is such that the treatment liquid contains a polymerization initiator, diffusion preventing agent, and oil (high-boiling organic solvent), and each of the colored inks contains a UV monomer (ultraviolet radiation-curable monomer) and a coloring material (colorant). According to this combination of the treatment liquid and the colored inks, image degradation due to deposition interference can be avoided primarily through the action of the diffusion preventing agent contained in the treatment liquid. Moreover even in the case where leaked light from the preliminary curing light sources 34 or reflected light from the recording paper 16 reaches the nozzles of the ink ejection heads 30 and the treatment liquid ejection heads 32, polymerization does not occur since none of the liquids contains both the polymerization initiator and the UV monomer together, whereby solidification of the treatment liquid and the inks in the nozzles of each of the heads can be prevented. Moreover, in the case of a mode in which each colored ink contains the polymerization initiator, and the treatment liquid contains the UV monomer, effects as above can be brought about.

Note that each colored ink may contain a UV oligomer and an ultraviolet radiation-curable polymerizable compound such as a mixture of a UV monomer and a UV oligomer, instead of, or together with, the UV monomer.

Moreover, in the case where the treatment liquid is deposited over a larger area than that over which the inks are deposited so as to prevent image disturbance, if the treatment liquid contains the polymerization initiator and the UV monomer, then all of the treatment liquid can be cured.

Although the preliminary curing light sources 34 (34A, 34B) and the main curing light source 36 are described in detail later, the size of the preliminary curing light sources 34 (34A, 34B) is approximately the same as the size of the ink ejection heads 30 in the paper conveyance direction (sub-scanning direction) and the size of the treatment liquid ejection heads 32 in the paper conveyance direction (sub-scanning direction). The preliminary curing light sources 34 (34A, 34B) irradiate the area of the recording paper 16 onto which the ink ejection heads 30 and the treatment liquid ejection heads 32 have ejected droplets with UV so as to carry out preliminary curing of the colored inks. On the other hand, the main curing light source 36 is configured so as to extend in the paper width direction of the recording paper 16 (the direction orthogonal to the paper conveyance direction), and performs irradiation of UV over the whole width of the recording paper 16 so as to carry out main curing of the colored inks. For example, each of the preliminary curing light sources 34 may be constituted from a UV LED element or the like, and the main curing light source 36 may be constituted from a metal halide lamp or the like.

Configuration of Ejection Heads

Next, the configuration of the ink ejection heads 30 (30K, 30C, 30M, 30Y) and the treatment liquid ejection heads 32 (32A, 32B) is described below. The configuration is common to each of the ejection heads 30 and 32, and hence in the following reference numeral 50 is used to represent each of these ejection heads.

Figure 3:
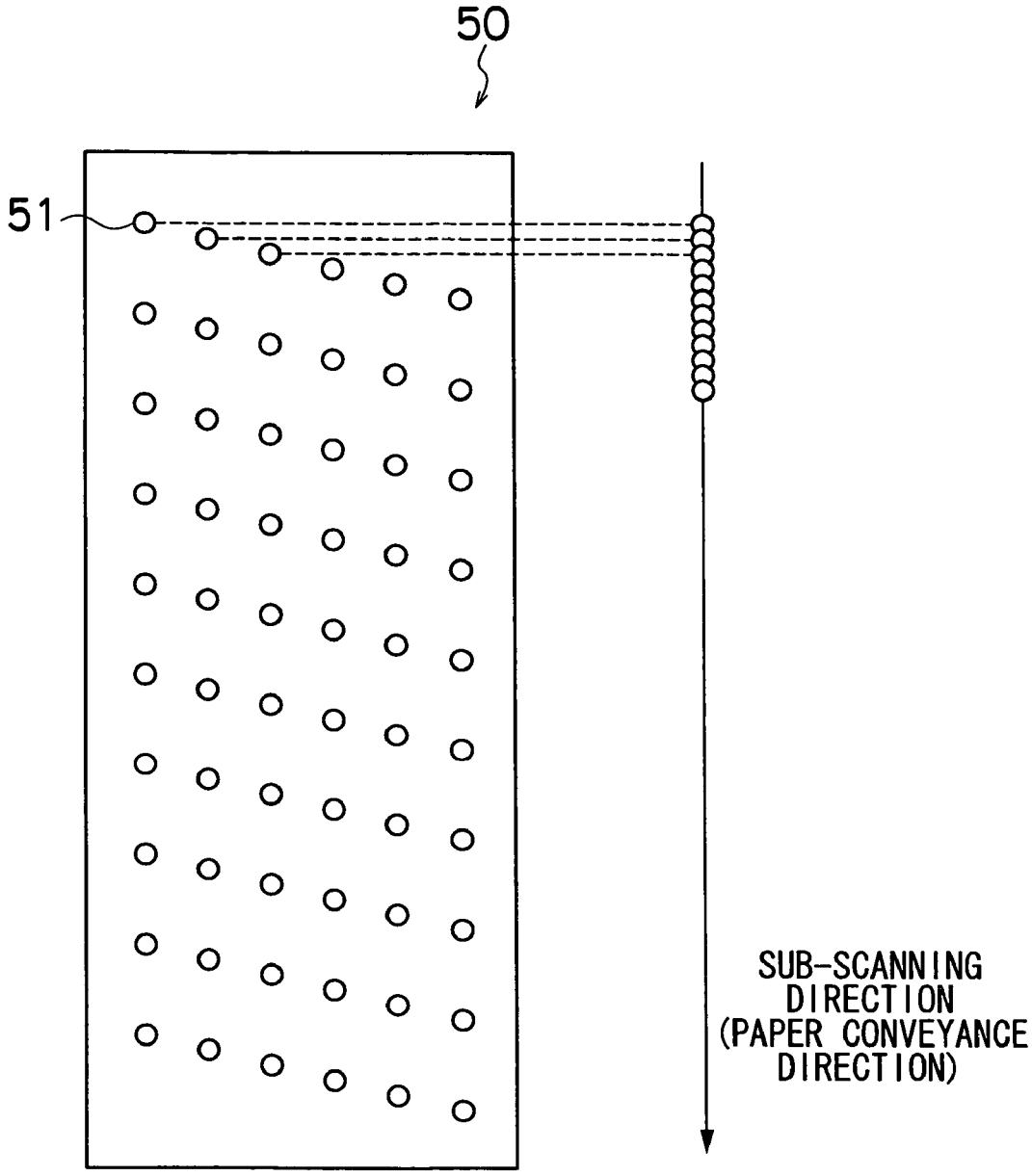
FIG. 3 is a plan view showing an ejection surface of an ejection head.

FIG. 3 is a plan view showing an ejection surface of the ejection head 50. As shown in FIG. 3, nozzles 51 from which the ink or treatment liquid is ejected are formed in a (two-dimensional) staggered matrix shape in the ejection surface of the ejection head 50. In a projected nozzle row obtained by projecting the nozzles along the sub-scanning direction (paper conveyance direction), the nozzles are arranged at equal intervals with a constant nozzle pitch, whereby the dot pitch is effectively made to be of higher density.

Figure 4:
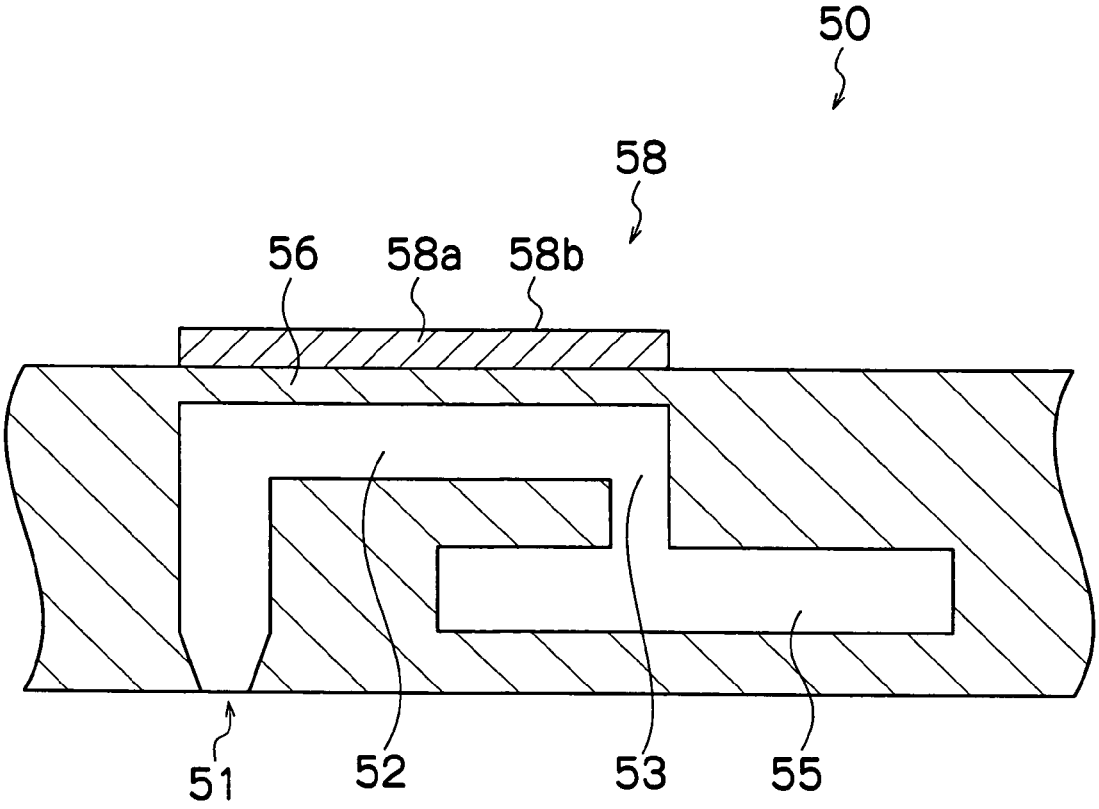
FIG. 4 is a side sectional view showing part of the ejection head.

FIG. 4 is a side sectional view showing part of the ejection head 50. As shown in FIG. 4, pressure chambers 52 each of which communicates with one of the nozzles 51 are formed inside the ejection head 50. Each pressure chamber 52 communicates with a common channel 55 via a supply port 53 formed in one end of the pressure chamber 52. The common channel 55 has stored therein a predetermined liquid (one of the colored inks or the treatment liquid) that is supplied from an ink tank (not shown) disposed in the liquid storing/loading unit 14 shown in FIG. 1. The predetermined liquid is supplied from the common channel 55 via the supply port 53 into the pressure chamber 52.

An upper wall of the pressure chambers 52 is constituted by a diaphragm 56. Piezoelectric elements 58 that are positioned in correspondence with the pressure chambers 52 are joined to a surface of the diaphragm 56 (on the opposite side to the pressure chambers 52). Each piezoelectric element 58 has a structure in which an individual electrode (driving electrode) 58*b* is provided on an upper surface of a thin film-shaped piezoelectric body 58*a*. The diaphragm 56 is made of a conductive material, and also acts as a common electrode for the plurality of piezoelectric elements 58.

According to this configuration, upon a predetermined driving voltage (driving signal) being applied to a piezoelectric element 58 from a driving circuit (not shown), the diaphragm 56 bends toward the corresponding pressure chamber 52 due to displacement of the piezoelectric element 58, whereby the liquid in the pressure chamber 52 is pressurized. A liquid droplet is thus ejected from the nozzle 51 communicated to the pressure chamber 52. After that, upon the application of the driving voltage being lifted, the diaphragm 56 returns to its original state, whereby the predetermined liquid is again supplied into the pressure chamber 52 via the supply port 53 from the common channel 55, so as to become ready for the next droplet ejection operation.

Figure 5:
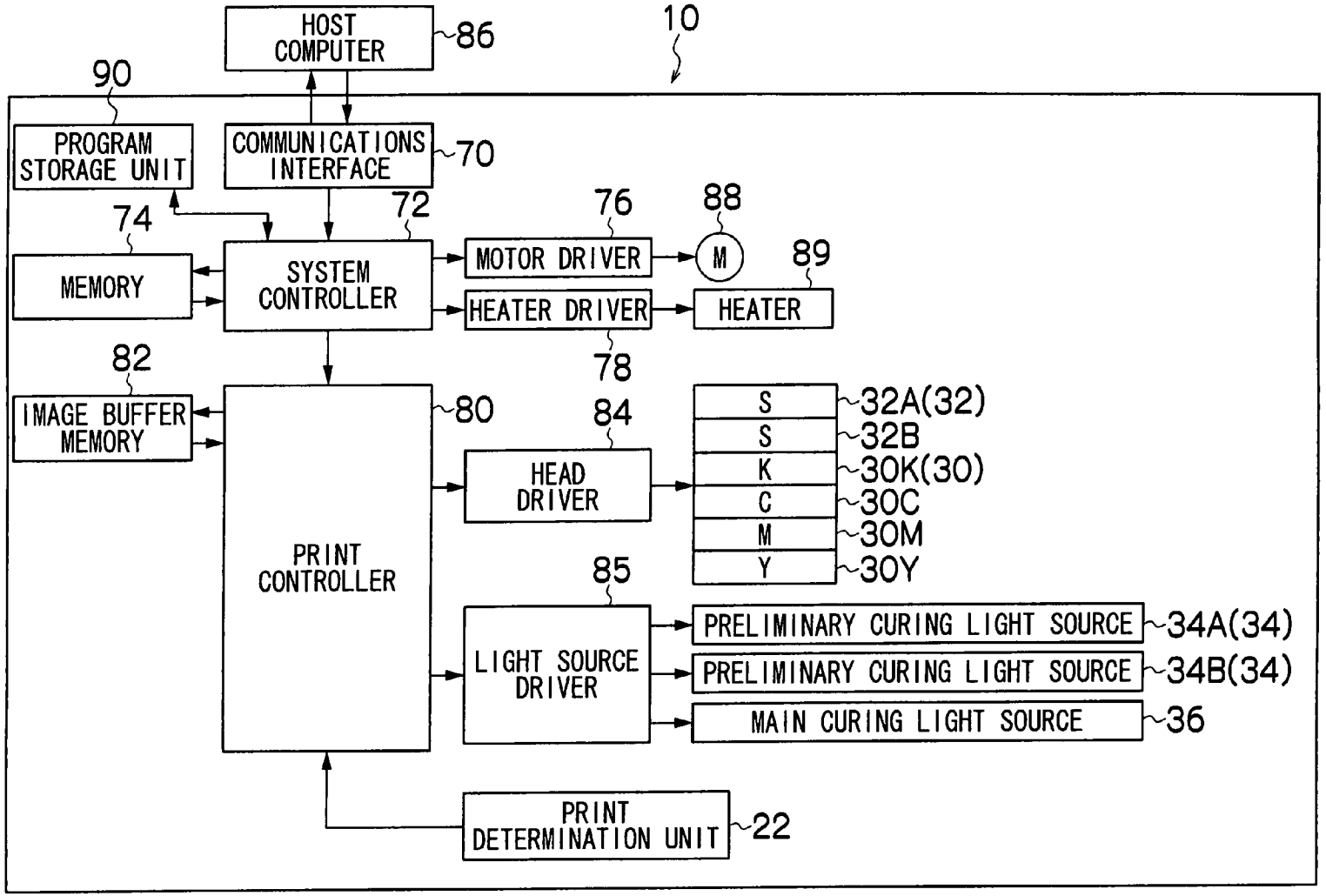
FIG. 5 is a principal block diagram showing the system configuration of the inkjet recording apparatus.

FIG. 5 is a principal block diagram showing the system configuration of the inkjet recording apparatus 10. The inkjet recording apparatus 10 comprises a communications interface 70, a system controller 72, a memory 74, a motor driver 76, a heater driver 78, a print controller 80, an image buffer memory 82, a head driver 84, a light source driver 85, and the like.

The communications interface 70 is an interface unit for receiving image data sent from a host computer 86. A serial interface such as USB, IEEE1394, Ethernet, wireless network, or a parallel interface such as a Centronics interface may be used as the communications interface 70. A buffer memory (not shown) may be mounted in this portion in order to increase the communication speed. The image data sent from the host computer 86 is received by the inkjet recording apparatus 10 through the communications interface 70, and is temporarily stored in the memory 74.

The memory 74 is a storage device for temporarily storing images inputted through the communications interface 70, and data is written and read to and from the memory 74 through the system controller 72. The memory 74 is not limited to a memory composed of semiconductor elements, and a hard disk drive or another magnetic medium may be used.

The system controller 72 is constituted from a central processing unit (CPU), peripheral circuits, and so on, and functions as a controller that carries out overall control of the inkjet recording apparatus 10 in accordance with a predetermined program, and also functions as a calculating apparatus that carries out various calculations. That is, the system controller 72 controls the various units such as the communications interface 70, the memory 74, the motor driver 76, and the heater driver 78, and carries out control of communication with the host computer 86, control of writing and reading to and from the memory 74, and so on, and also produces control signals for controlling a motor 88 such as a conveyance system motor, and a heater 89 such as a heater for adjusting the temperature of the inkjet recording apparatus 10 (the ejection heads etc.).

The program executed by the CPU of the system controller 72 and the various types of data which are required for control procedures are stored in the memory 74. The memory 74 may be a non-writeable storage device, or it may be a rewriteable storage device, such as an EEPROM. The memory 74 is used as a temporary storage region for the image data, and it is also used as a program development region and a calculation work region for the CPU.

The motor driver 76 is a driver (driving circuit) that drives the motor 88 in accordance with instructions from the system controller 72. The heater driver 78 is a driver that drives the heater 89 such as the heater for adjusting the temperature of the inkjet recording apparatus 10 (the ejection heads etc.) in accordance with instructions from the system controller 72.

The print controller 80 is a controller that has a signal processing function of carrying out various processing, corrections and so on for producing printing controlling signals from the image data in the memory 74 in accordance with control from the system controller 72, and supplies the printing data (dot data) thus produced to the head driver 84. Required signal processing is carried out in the print controller 80, and then control of the ejection amount for the treatment liquid droplets from the treatment liquid ejection heads 32 (32A, 32B) and the ejection amount and the ejection timing for the ink droplets from the ink ejection heads 30 (30K, 30C, 30M, 30Y) are carried out via the head driver 84 on the basis of the image data. As a result, a desired dot size and dot arrangement is realized.

The print controller 80 is provided with the image buffer memory 82; and image data, parameters, and other data are temporarily stored in the image buffer memory 82 when image data is processed in the print controller 80. Also possible is an aspect in which the print controller 80 and the system controller 72 are integrated to form a single processor.

The head driver 84 drives the piezoelectric elements 58 (see FIG. 4) of the treatment liquid ejection heads 32 and the ink ejection heads 30 for the respective colors, on the basis of printing data supplied from the print controller 80. The head driver 84 may include a feedback control system for keeping the head driving conditions constant.

The light source driver 85 functions as a control block that controls power-on/power-off (the irradiation timing and the irradiation duration), the irradiation doses, and so on for the preliminary curing light sources 34 (34A, 34B) and the main curing light source 36. That is, the light source driver 85 controls power-on/power-off for the preliminary curing light sources 34 and the main curing light source 36, and also sets the irradiation doses for the preliminary curing light sources 34 and the main curing light source 36, on the basis of control signals supplied from the print controller 80.

The image data to be printed is externally inputted through the communications interface 70, and is stored in the memory 74. In this stage, the RGB image data is stored in the memory 74.

The image data stored in the memory 74 is sent to the print controller 80 via the system controller 72, and is converted into dot data for the treatment liquid and dot data for each of the colored inks in the print controller 80. That is, the print controller 80 carries out processing of converting the inputted RGB image data into dot data for the treatment liquid and the four colors KCMY. The dot data produced by the print controller 80 is stored in the image buffer memory 82.

The head driver 84 produces drive control signals for the treatment liquid ejection heads 32 and the ink ejection heads 30 on the basis of the dot data stored in the image buffer memory 82. The drive control signals produced by the head driver 84 are applied to the treatment liquid ejection heads 32 and the ink ejection heads 30, whereby droplets of the treatment liquid and the colored inks are ejected from the treatment liquid ejection heads 32 and the ink ejection heads 30, respectively. The ejection of droplets from the treatment liquid ejection heads 32 and the ink ejection heads 30 is synchronized with the speed of conveyance of the recording paper 16, whereby an image is formed on the recording paper 16.

The dots of the treatment liquid should contact the colored inks corresponding to the treatment liquid dots respectively, and hence the dot size for the treatment liquid may be made to be bigger than the dot size for the colored inks, and moreover the density (arrangement density) of the treatment liquid dots may be made to be lower than the density (arrangement density) of the colored ink dots.

That is, the dot data for the treatment liquid and the dot data for the colored inks may be produced such that the dot data for the treatment liquid is different to the dot data for the colored inks.

Various control programs are stored in a program storage unit 90 shown in FIG. 5. The control programs are read out and executed in accordance with instructions from the system controller 72. The program storage unit 90 may use a semiconductor memory such as a ROM or an EEPROM, or may use a magnetic disk or the like. An external interface may be provided, and a memory card or a PC card may be used. A plurality of these storage media may be provided. Moreover, the program storage unit 90 may also be used as a recording device (not shown) for operational parameters and so on.

In the present example, the system controller 72, the memory 74, the print controller 80 and so on have been shown as individual functional blocks; however, a configuration may also be adopted in which these are integrated together to form a single processor. Moreover, some of the functions of the system controller 72 and some of the functions of the print controller 80 may be achieved by a single processor.

Description of Control System

Figure 6:
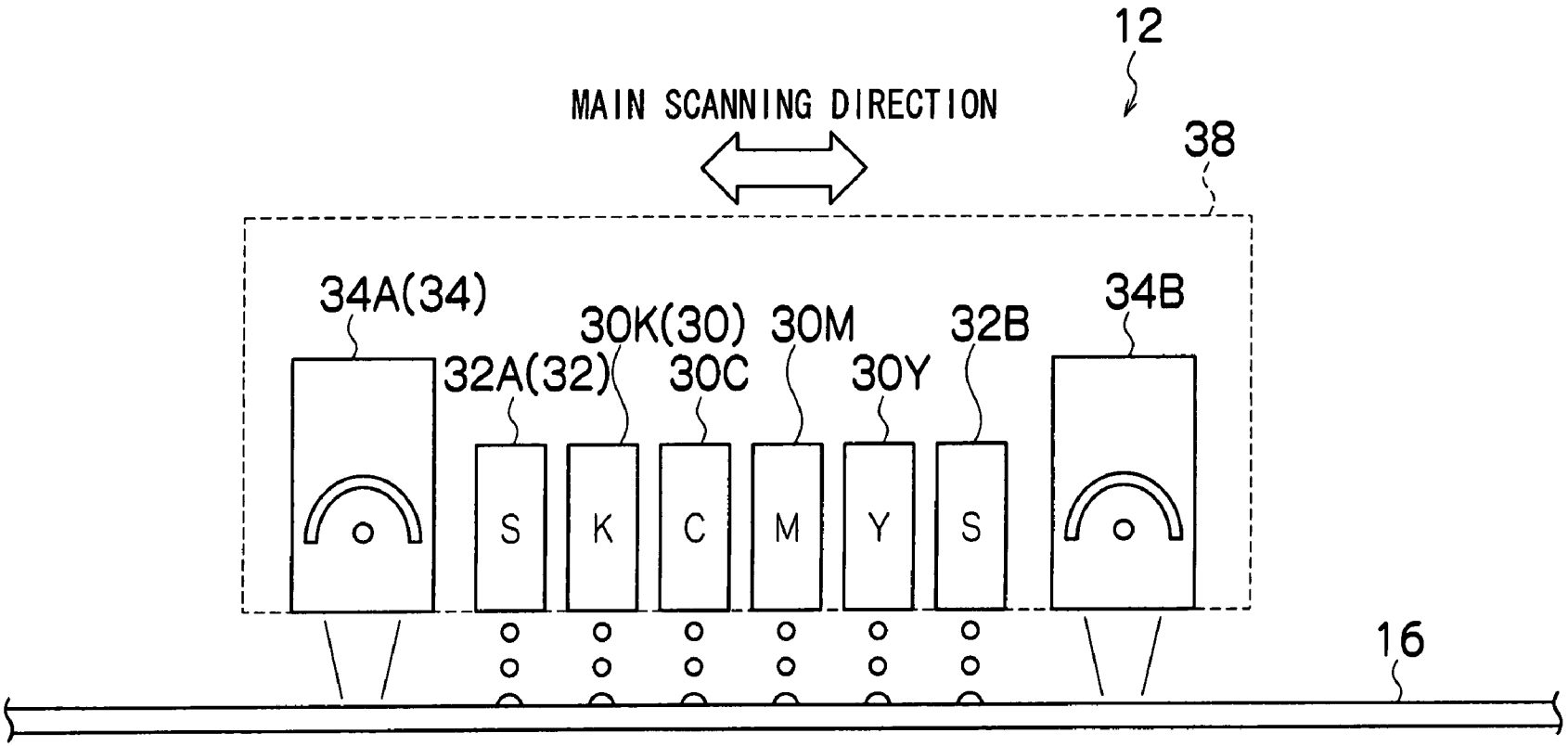
FIG. 6 is a front view of principal components of the inkjet recording apparatus.

FIG. 6 is a front view of principal components of the inkjet recording apparatus 10, showing schematically the print unit 12 as viewed from the left side in FIG. 1. While the ink ejection heads 30 (30K, 30C, 30M, 30Y), the treatment liquid ejection heads 32 (32A, 32B), and the preliminary curing light sources 34 (34A, 34B), which are mounted on the carriage 38 (shown by the broken line in FIG. 6) in the predetermined order in the main scanning direction, scan to and fro in the main scanning direction together with the carriage 38, predetermined operations are carried out in an order as follows in predetermined positions on the recording paper 16. Note that "predetermined positions on the recording paper 16" refers to dot formation positions on the recording paper 16 where the ink ejection heads 30 and the treatment liquid ejection heads 32 are to deposit droplets on the basis of the dot data (printing data) described above.

When the carriage 38 is moving from the left to the right in FIG. 6, the treatment liquid ejection head 32B ejects the treatment liquid, and then the ink ejection heads 30Y, 30M, 30C, and 30K eject the colored inks in predetermined order.

In the case where the amount of the treatment liquid on the recording paper 16 is insufficient, the treatment liquid ejection head 32A may then eject the treatment liquid. After that, the preliminary curing light source 34A irradiates the treatment liquid and the colored inks on the recording paper 16 with UV. On the other hand, when the carriage 38 is moving from the right to the left in FIG. 6, the treatment liquid ejection head 32A ejects the treatment liquid, and then the ink ejection heads 30K, 30C, 30M, and 30Y eject the colored inks in predetermined order. In the case where the amount of the treatment liquid on the recording paper 16 is insufficient, the treatment liquid ejection head 32B may then eject the treatment liquid. After that, the preliminary curing light source 34B irradiates the treatment liquid and the colored inks on the recording paper 16 with UV.

In this way, regardless of in which direction the carriage 38 is moving, the colored inks are ejected from the ink ejection heads 30 (30K, 30C, 30M, 30Y) after the treatment liquid has been deposited on the recording paper 16 by one of the treatment liquid ejection heads 32 (i.e., the treatment liquid ejection head 32A or 32B), whereby image degradation due to deposition interference is prevented.

Moreover, the treatment liquid and the colored inks on the recording paper 16 are irradiated with UV from one of the preliminary curing light sources 34 after the colored inks have been deposited. Upon the treatment liquid and the colored inks being irradiated with UV, radicals are generated from the polymerization initiator contained in the treatment liquid, polymerization of the UV monomer(s) (ultraviolet radiation-curable monomer(s)) contained in the colored inks is brought about, and thereby the image (dots) formed from the colored inks is (are) put into a half-cured state. The "half-cured state" here refers to a state in which the dots formed on the recording paper 16 are cured to an extent such that the dots do not move, or a state in which at least the surface of each of the ink droplets is cured (i.e., a cured film is formed on the surface of each of the ink droplets), so that the curing has taken place to an extent that mixing between ink droplets does not occur.

The recording paper 16 is conveyed in the paper conveyance direction, and the half-cured dots thus formed on the recording paper 16 are irradiated with UV by the main curing light source 36 (see FIG. 2) upon moving substantially directly under the main curing light source 36, which is disposed downstream of the carriage 38 (after the carriage 38) in the paper conveyance direction (sub-scanning direction). As a result, the dots become fixed on the recording paper 16 in a completely cured state, whereby a good image can be obtained.

In the present embodiment, unlike in another embodiment described later (see FIG. 7), the treatment liquid ejection heads 32 are disposed between the ink ejection heads 30 and one of the preliminary curing light sources 34. In general, the light sources are larger in size than the ejection heads, and hence by disposing the treatment liquid ejection heads 32 adjacent to the ink ejection heads 30 as in FIG. 6, the time from the treatment liquid being deposited to the inks being deposited can be shortened. As a result, in the case where a recording medium having high permeability is used, a phenomenon in which the treatment liquid permeates through the recording medium before the inks are deposited and hence the treatment liquid is not effective, can be prevented from occurring.

Description of Treatment Liquid and Inks (Ink Set)

A detailed description of the ink set used in the inkjet recording apparatus 10 according to an embodiment of the present invention is given below.

In the inkjet recording apparatus 10 shown in the present embodiment, there is used an ink set constituted from various colored inks each containing a polymerizable compound, and a coloring material, and a treatment liquid containing a polymerization initiator, a diffusion preventing agent, and a high-boiling solvent.

Polymerizable Compounds (Radiation-curable Monomers and Oligomers)

"Polymerizable compound" refers to a compound that has a capability of undergoing polymerization and hence curing through the action of initiating species such as radicals generated from a polymerization initiator, described below.

Each polymerizable compound is preferably an addition polymerization-undergoing compound having at least one ethylenic unsaturated double bond therein, and is preferably selected from polyfunctional compounds having at least one terminal ethylenic unsaturated bond, more preferably at least two terminal ethylenic unsaturated bonds, therein. The group of such compounds is widely known in the industrial field in question, and these compounds can be used with no particular limitations thereon. These compounds include, for example, ones having chemical forms such as monomers, and prepolymers, i.e. dimers, trimers and other oligomers, and mixtures or copolymers thereof.

The polymerizable compound preferably has a polymerizable group such as an acryloyl group, a methacryloyl group, an allyl group, a vinyl group, or an internal double bond group (maleic acid etc.) in the molecule thereof. Of these, a compound having an acryloyl group or a methacryloyl group is preferable since the curing reaction can be brought about with little energy.

In each liquid, one polymerizable compound only may be used, or a plurality of polymerizable compounds may be used in combination.

The polymerizable compound content in the first liquid containing colorant is preferably in a range of 50 to 99% by mass, more preferably 70 to 99% by mass, yet more preferably 80 to 99% by mass, of the first liquid.

Polymerization Initiators (Curing Initiators, Reaction Initiators)

"Polymerization initiator" refers to a compound that generates initiating species such as radicals through light, or heat, or both of these types of energy, thus initiating and promoting the polymerization of the polymerizable compound(s). A publicly known thermal polymerization initiator a compound having therein a bond with a low bond dissociation energy, a photopolymerization initiator, or the like can be selected and used.

Examples of such radical generating agents include halogenated organic compounds, carbonyl compounds, organic peroxide compounds, azo type polymerization initiators, azide compounds, metallocene compounds, hexaarylbiimidazole compounds, organic borate compounds, disulfonic acid compounds, and onium salt compounds.

In the ink set of an embodiment the present invention, a polymerization initiator that cures the polymerizable compound(s) is contained in at least one of the plurality of liquids used.

From the viewpoint of stability over time, curability and curing rate, the polymerization initiator content is preferably 0.5 to 20% by mass, more preferably 1 to 15% by mass, yet more preferably 3 to 10% by mass, relative to all of the polymerizable compounds used in the ink set.

One polymerization initiator may be used, or a plurality of polymerization initiators may be used in combination. Moreover, so long as there is no impairment of the effects of the present invention, the polymerization initiator(s) may be used together with a publicly known sensitizer with an object of improving the sensitivity.

Colorants (Coloring Materials)

There are no particular limitations on the colorants used in an embodiment of the present invention. So long as these colorants are such that a hue and color density suitable for the ink usage can be attained, ones selected as appropriate from publicly known water-soluble dyes, oil-soluble dyes and pigments can be used. Of these, from the viewpoint of ink droplet ejection stability and quick drying ability, the liquids constituting the inkjet recording inks in the present invention are preferably water-insoluble liquids not containing an aqueous solvent. From this viewpoint, it is preferable to use an oil-soluble dye or pigment that readily disperses or dissolves uniformly in the water-insoluble liquid.

There are no particular limitations on oil-soluble dyes that can be used in the present invention, with it being possible to use one chosen as desired. The dye content in the case of using an oil-soluble dye as a colorant is preferably in a range of 0.05 to 20% by mass, more preferably 0.1 to 15% by mass, particularly preferably 0.2 to 6% by mass, in terms of solid content.

A mode in which a pigment is used as a colorant is preferable from the viewpoint of aggregation readily occurring when the plurality of liquids are mixed together.

As pigments that can be used in the present invention, either organic pigments or inorganic pigments can be used. A carbon black pigment is preferable as a black pigment. In general, a black pigment, and pigments of the three primary colors, cyan, magenta and yellow, are used; however, pigments having other hues, for example red, green, blue, brown or white pigments, pigments having a metallic luster such as gold or silver pigments, uncolored or light body pigments, and so on may also be used in accordance with the object.

Moreover, particles obtained by fixing a dye or a pigment to the surface of a core material made of silica, alumina, a resin or the like, an insoluble lake pigment obtained from a dye, a colored emulsion, a colored latex, or the like may also be used as a pigment.

Furthermore, a resin-coated pigment may also be used. Such a resin-coated pigment is known as a "microcapsule pigment", and is commercially available from manufacturers such as Dainippon Ink and Chemicals Inc. and Toyo Ink Mfg. Co., Ltd.

From the viewpoint of the balance between the optical density and the storage stability, the volume average particle diameter of the pigment particles contained in a liquid in the present invention is preferably in a range of 30 to 250 nm, more preferably 50 to 200 nm. Here, the volume average particle diameter of the pigment particles can be measured, for example, using a measuring apparatus such as an LB-500 (made by HORIBA Ltd.).

From the viewpoint of the optical density and the ejection stability, the pigment content in the case of using a pigment as a colorant is preferably in a range of 0.1 to 20% by mass, more preferably 1 to 10% by mass, in terms of solid content in each first liquid.

One colorant only may be used, or a plurality of colorants may be used mixed together. Moreover, different colorants, or the same colorants, may be used in each of the liquids.

Diffusion Preventing Agents (Polymers)

In an embodiment of the present invention, "diffusion preventing agent" refers to a substance contained in the second liquid with an object of preventing diffusion and smearing of the colorant-containing first liquids of which droplets are deposited onto the second liquid that has been put onto the recording medium.

As such a diffusion preventing agent, there is contained at least one selected from the group of polymers having an amino group, polymers having an onium group, polymers having a nitrogen-containing hetero ring, and metal compounds.

One of the above polymers or the like may be used, or a plurality may be used in combination. "Plurality" includes both, for example, the case of polymers that are polymers having an amino group but have different structures to one another, and the case of different types such as a polymer having an amino group and a polymer having an onium group. Moreover, a combination selected from amino groups, onium groups, nitrogen-containing hetero rings, and metal compounds may be present together in one molecule.

Following is a detailed description of these polymers and so on.

Polymers Having an Amino Group

A homopolymer of an only monomer having an amino group, or a copolymer of a monomer of an amino group and another monomer may be used as a polymer having an amino group. The "monomer having an amino group" content in the polymer having an amino group is preferably not less than 10 mol % but not more than 100 mol %, more preferably not less than 20 mol % but not more than 100 mol %.

Examples of monomers having an amino group include N,N-dimethylaminoethyl(meth)acrylate, N,N-diethylaminoethyl(meth)acrylate, N,N-dimethylaminopropyl(meth)acrylate, N,N-diethylaminopropyl(meth)acrylate, N,N-dimethylaminoethyl(meth)acrylamide, N,N-diethylaminoethyl(meth)acrylamide, N,N-dimethylaminopropyl(meth)acrylamide, N,N-diethylaminopropyl(meth)acrylamide, diallylamine, N-methyldiallylamine, N-vinylbenzyl-N,N-dimethylamine, N-vinylbenzyl-N,N-diethylamine, N-vinylbenzyl-N-ethyl-N-methylamine, N-vinylbenzyl-N,N-dihexylamine, N-vinylbenzyl-N-octadecyl-N-methylamine, N-vinylbenzyl-N'-methyl-piperazine, N-vinylbenzyl-N'-(2-hydroxyethyl)-piperazine, N-benzyl-N-methylaminoethyl(meth)acrylate, and N,N-dibenzylaminoethyl(meth)acrylate.

Of these, N,N-dimethylaminoethyl(meth)acrylate, N,N-diethylaminoethyl(meth)acrylate, N,N-dimethylaminopropyl(meth)acrylate, N,N-diethylaminopropyl(meth)acrylate, N,N-dimethylaminoethyl(meth)acrylamide, N,N-diethylaminoethyl(meth)acrylamide, N,N-dimethylaminopropyl(meth)acrylamide, and N,N-diethylaminopropyl(meth)acrylamide are more preferable, with N,N-dimethylaminoethyl(meth)acrylate, N,N-diethylaminoethyl(meth)acrylate, and N,N-dimethylaminopropyl(meth)acrylamide being particularly preferable.

Examples of monomers that can be copolymerized with these monomers include (meth)acrylic acid alkyl esters (e.g. (meth)acrylic acid alkyl esters having 1 to 18 carbon atoms in the alkyl part thereof such as methyl(meth)acrylate, ethyl(meth)acrylate, propyl(meth)acrylate, isopropyl(meth)acrylate, n-butyl(meth)acrylate, isobutyl(meth)acrylate, t-butyl(meth)acrylate, hexyl(meth)acrylate, octyl(meth)acrylate, 2-ethylhexyl(meth)acrylate, lauryl(meth)acrylate, and stearyl(meth)acrylate), (meth)acrylic acid cycloalkyl esters (e.g. cyclohexyl(meth)acrylate, etc.), (meth)acrylic acid aryl esters (e.g. phenyl(meth)acrylate, etc.), (meth)acrylic acid aralkyl esters (e.g. benzyl(meth)acrylate, etc.), substituted (meth)acrylic acid alkyl esters (e.g. 2-hydroxyethyl(meth)acrylate, etc.), (meth)acrylamides (e.g. (meth)acrylamide, dimethyl(meth)acrylamide, etc.), aromatic vinyl compounds (e.g. styrene, vinyltoluene, α-methylstyrene, etc.), vinyl esters (e.g. vinyl acetate, vinyl propionate, vinyl versatate, etc.), allyl esters (e.g. allyl acetate, etc.), halogen-containing monomers (e.g. vinylidene chloride, vinyl chloride, etc.), vinyl cyanides (e.g. (meth)acrylonitrile, etc.), and olefins (e.g. ethylene, propylene, etc.).

Of these copolymerizable monomers, (meth)acrylic acid alkyl esters having an alkyl group having 1 to 8 carbon atoms, benzyl(meth)acrylate, and styrene are preferable, with ethyl (meth)acrylate, propyl(meth)acrylate, n-butyl(meth)acrylate, n-hexyl(meth)acrylate, and 2-ethylhexyl(meth)acrylate being particularly preferable.

Furthermore, other polymers having an amino group include polyallylamine, polyvinylamine, polyethyleneimine, polydiallylamine, poly(N-methyldiallylamine), poly(N-ethyldiallylamine), and modified compounds thereof (a benzyl chloride adduct, a phenyl glycidyl ether adduct, and an acrylonitrile adduct of polyallylamine), and polyadducts between a diisocyanate (e.g. hexamethylene diisocyanate, isophorone diisocyanate, toluene diisocyanate, or xylylene diisocyanate) and a diol having a tertiary amino group (e.g. N-methyldiethanolamine, N-ethyldiethanolamine, or N,N'-3-hydroxypropylpiperazine).

Of these, polyallylamine, polyvinylamine, polyethyleneimine, and modified compounds thereof are preferable, with a modified compound of polyallylamine being particularly preferable.

In the present invention, as a polymer having an amino group, a polymer having therein a unit represented by the following general formula (1) is particularly preferable.

(GENERAL FORMULA 1)

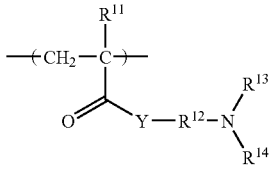

In general formula (1), $R^{11}$ represents hydrogen or a methyl group, Y represents O or $NR^{15}$, $R^{15}$ represents hydrogen or an alkyl group, $R^{12}$ represents a bivalent connecting group, and $R^{13}$ and $R^{14}$ each independently represents an alkyl group, an aralkyl group, or an aryl group.

Hydrogen is more preferable as $R^{11}$, O or NH is more preferable as Y, with O being yet more preferable, and an alkyl group or an aralkyl group is more preferable as each of $R^{13}$ and $R^{14}$, with an alkyl group being yet more preferable.

As the bivalent connecting group represented by $R^{12}$, an alkylene group or an arylene group is preferable, with an alkylene group being more preferable.

Specific examples of the bivalent connecting group include a methylene group, an ethylene group, a propylene group, a trimethylene group, a tetramethylene group, a hexamethylene group, an octamethylene group, a phenylene group, and a 2-hydroxypropylene group. Of these, an ethylene group, a propylene group, and a trimethylene group are preferable.

As an alkyl group represented by $R^{13}$, $R^{14}$ or $R^{15}$, an alkyl group having not more than 18 carbon atoms is preferable, with an alkyl group having not more than 12 carbon atoms being more preferable, and an alkyl group having not more than 8 carbon atoms being particularly preferable. The alkyl group may be straight chain, or cyclic, and may have substituents, examples of the substituents including a hydroxy group, alkoxy groups (e.g. a methoxy group, an ethoxy group, a propoxy group, etc.), aryloxy groups (e.g. a phenoxy group, etc.), amino groups, carbamoyl groups, and halogen atoms.

Specific examples of such (substituted) alkyl groups include a methyl group, an ethyl group, an n-propyl group, an isopropyl group, an n-butyl group, an isobutyl group, a t-butyl group, an n-hexyl group, a cyclohexyl group, a 2-ethylhexyl group, an n-octyl group, an n-nonyl group, an n-decyl group, an n-dodecyl group, an n-octadecyl group, a hydroxyethyl group, a 1-hydroxypropyl group, an N,N-dimethylaminoethyl group, a methoxyethyl group, and a chloroethyl group. Of these, a methyl group, an ethyl group, an n-propyl group, an isopropyl group, an n-butyl group, an isobutyl group, a t-butyl group, an n-hexyl group, a cyclohexyl group, a 2-ethylhexyl group, an n-octyl group, an n-nonyl group, and an n-decyl group are more preferable, with a methyl group, an ethyl group, an n-propyl group, an n-butyl group, and an n-hexyl group being particularly preferable.

As an aryl group represented by $R^{13}$ or $R^{14}$, an aryl group having not more than 18 carbon atoms is preferable, with an aryl group having not more than 16 carbon atoms being more preferable, and an aryl group having not more than 12 carbon atoms being particularly preferable. Moreover, the aryl group may have substituents.

Specific examples of such (substituted) aryl groups include a phenyl group, alkylphenyl groups (e.g. a methylphenyl group, an ethylphenyl group, an n-propylphenyl group, an n-butylphenyl group, a cumenyl group, a mesityl group, a tolyl group, a xylyl group, etc.), a naphthyl group, a chlorophenyl group, a dichlorophenyl group, a trichlorophenyl group, a bromophenyl group, a hydroxyphenyl group, a methoxyphenyl group, an acetoxyphenyl group, and a cyanophenyl group. Of these, a phenyl group and a naphthyl group are particularly preferable.

As an aralkyl group represented by $R^{13}$ or $R^{14}$, an aralkyl group having not more than 18 carbon atoms is preferable, with an aralkyl group having not more than 16 carbon atoms being more preferable, and an aralkyl group having not more than 12 carbon atoms being particularly preferable. Examples of the alkyl part of the aralkyl group are alkyl groups as above, and examples of the aryl part of the aralkyl group are aryl groups as above. Moreover, the aralkyl group may have substituents.

Specific examples of such (substituted) aralkyl groups include a benzyl group, a phenylethyl group, a vinylbenzyl group, a hydroxyphenylmethyl group, a diphenylmethyl group, a trityl group, and a styryl group. Of these, a benzyl group is particularly preferable.

Preferable specific examples of polymers having units represented by the general formula (1) are as follows.

P1-1

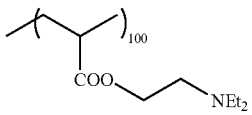

P1-2

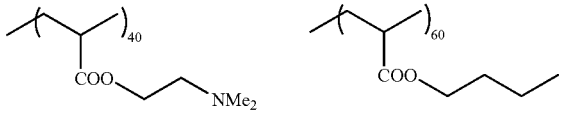

-continued

P1-3

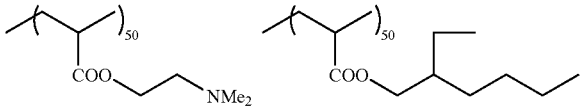

P1-4

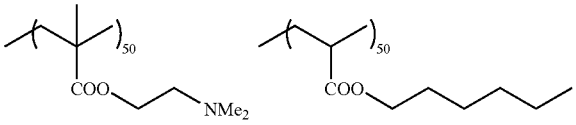

P1-5

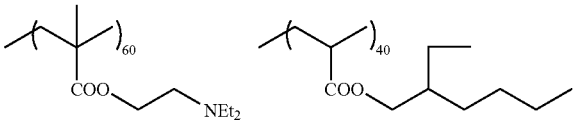

P1-6

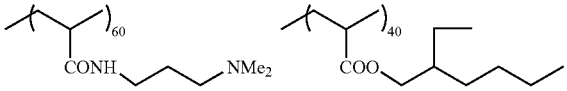

P1-7

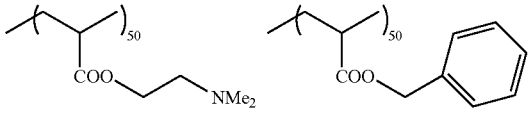

P1-8

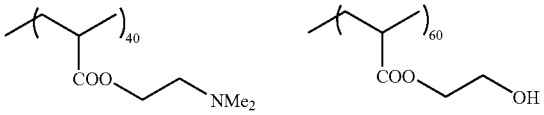

P1-9

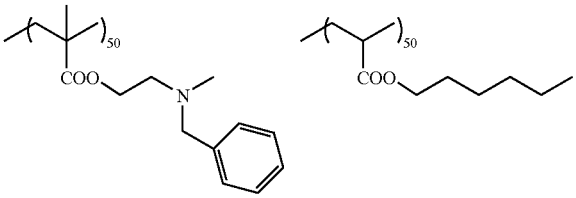

P1-10

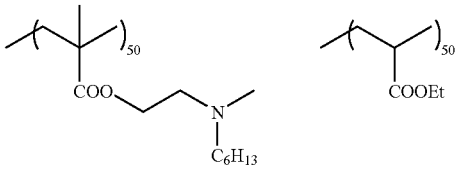

P1-11

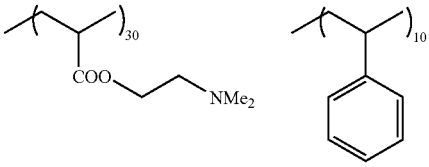

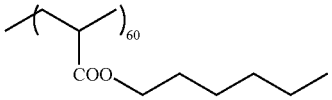

-continued

P1-12

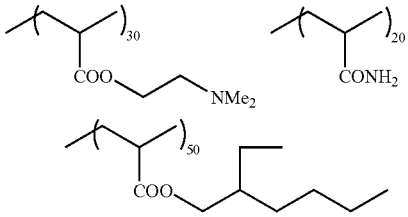

P1-13

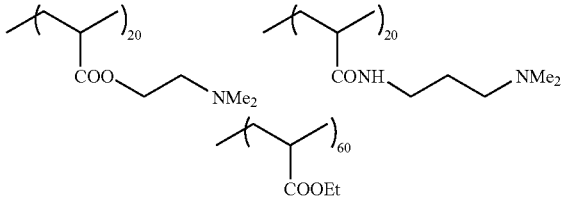

P1-14

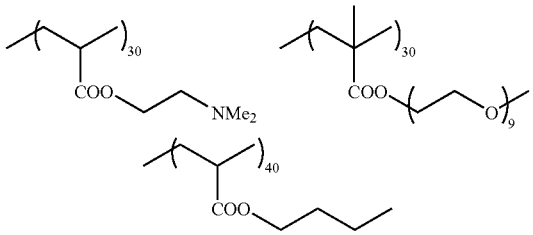

Preferable polymers having an amino group according to the present invention other than polymers having units represented by general formula (1) are as follows.

P1-15

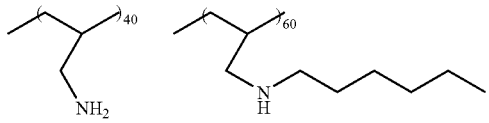

P1-16

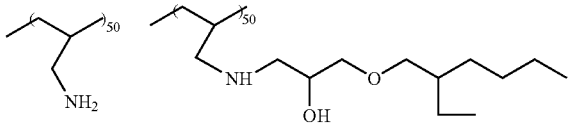

P1-17

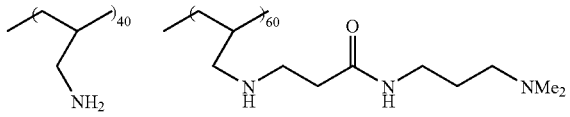

P1-18

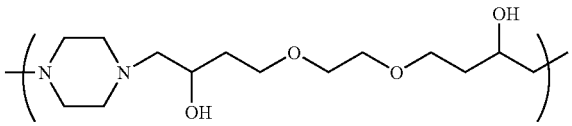

A polymer having therein a unit represented by general formula (1) can be synthesized using radical (co)polymerization. As the radical (co)polymerization, for example, a publicly known method such as bulk polymerization, solution polymerization, or emulsion polymerization can be used.

However, there is no limitation to such a method, with it also being possible to use another publicly known method.

The weight average molecular weight of a polymer having an amino group used in the present invention is preferably in a range of 1000 to 50000, particularly preferably 2000 to 30000.

It is preferable for such a polymer having an amino group to be contained in at least one liquid not containing a colorant. The amount used of the polymer having an amino group in the present invention is preferably in a range of 1 to 90% by mass, more preferably 10 to 75% by mass, particularly preferably 20 to 50% by mass, relative to all of each liquid. If the amount used is less than this, then it may not be possible to realize the effects of the present invention effectively, whereas if the amount used is greater than this, then the viscosity may become high, and hence problems with the ink ejectability may arise.

Polymers Having an Onium Group

A polymer having an onium group may be a homopolymer of only a monomer having an onium group, or a copolymer of a monomer having an onium group and another monomer. The "monomer having an onium group" content in the polymer having an onium group is preferably not less than 10 mol %, more preferably not less than 20 mol %.

Examples of the onium group are an ammonium group, a phosphonium group, and a sulfonium group, with an ammonium group being preferable. A polymer having an ammonium group can be obtained as a homopolymer of a monomer having a quaternary ammonium salt group, or a copolymer or a condensation polymer between a monomer having a quaternary ammonium salt group and another monomer.

In the present invention, as a polymer having an ammonium group, a polymer having therein at least a unit represented by the following general formula (2) or (3) is particularly preferable.

(GENERAL FORMULA 2)

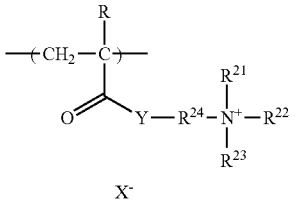

(GENERAL FORMULA 3)

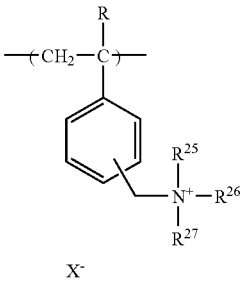

In the formulae, R represents a hydrogen atom or a methyl group, and $R^{21}$ to $R^{23}$ and $R^{25}$ to $R^{27}$ each independently represent an alkyl group, an aralkyl group, or an aryl group. $R^{24}$ represents an alkylene group, an aralkylene group, or an arylene group. Y represents O or NR', and R' represents a hydrogen atom or an alkyl group. $X^-$ represents a counter anion.

As an alkyl group represented by one of $R^{21}$ to $R^{23}$ and $R^{25}$ to $R^{27}$, an alkyl group having not more than 18 carbon atoms is preferable, with an alkyl group having not more than 16 carbon atoms being more preferable, and an alkyl group having not more than 12 carbon atoms being particularly preferable. The alkyl group may be straight chain, or cyclic, and may have substituents, examples of the substituents including alkoxy groups, aryloxy groups, halogen atoms, a hydroxyl group, carbamoyl groups, and amino groups.

Specific examples of such (substituted) alkyl groups include a methyl group, an ethyl group, an n-propyl group, an isopropyl group, an n-butyl group, an isobutyl group, a t-butyl group, an n-hexyl group, a cyclohexyl group, a 2-ethylhexyl group, an n-octyl group, an n-nonyl group, an n-decyl group, an n-dodecyl group, an n-octadecyl group, a hydroxyethyl group, a 1-hydroxypropyl group, an N,N-dimethylaminoethyl group, a methoxyethyl group, and a chloroethyl group.

Of these alkyl groups, a methyl group, an ethyl group, an n-propyl group, an isopropyl group, an n-butyl group, an isobutyl group, a t-butyl group, an n-hexyl group, a cyclohexyl group, a 2-ethylhexyl group, an n-octyl group, an n-nonyl group, and an n-decyl group are more preferable, with a methyl group, an ethyl group, an n-propyl group, an n-butyl group, and an n-hexyl group being particularly preferable.

As an aryl group represented by one of $R^{21}$ to $R^{23}$ and $R^{25}$ to $R^{27}$, an aryl group having not more than 18 carbon atoms is preferable, with an aryl group having not more than 16 carbon atoms being more preferable, and an aryl group having not more than 12 carbon atoms being particularly preferable. Moreover, the aryl group may have substituents, examples of the substituents including alkyl groups, alkoxy groups, aryloxy groups, halogen atoms, a hydroxyl group, carbamoyl groups, a cyano group, and amino groups.

Specific examples of such (substituted) aryl groups include a phenyl group, alkylphenyl groups (e.g. a methylphenyl group, an ethylphenyl group, an n-propylphenyl group, an n-butylphenyl group, a cumenyl group, a mesityl group, a tolyl group, a xylyl group, etc.), a naphthyl group, a chlorophenyl group, a dichlorophenyl group, a trichlorophenyl group, a bromophenyl group, a hydroxyphenyl group, a methoxyphenyl group, an acetoxyphenyl group, and a cyanophenyl group.

Of these (substituted) aryl groups, a phenyl group and a naphthyl group are particularly preferable.

As an aralkyl group represented by one of $R^{21}$ to $R^{23}$ and $R^{25}$ to $R^{27}$, an aralkyl group having not more than 18 carbon atoms is preferable, with an aralkyl group having not more than 16 carbon atoms being more preferable, and an aralkyl group having not more than 12 carbon atoms being particularly preferable. Examples of the alkyl part of the aralkyl group are alkyl groups as above, and examples of the aryl part of the aralkyl group are aryl groups as above. The alkyl part and/or the aryl part of the aralkyl group may have substituents, examples of the substituents being as given above for the alkyl group and the aryl group.

Specific examples of such (substituted) aralkyl groups include a benzyl group, a phenylethyl group, a vinylbenzyl group, a hydroxyphenylmethyl group, a diphenylmethyl group, a trityl group, and a styryl group.

Of these (substituted) aralkyl groups, a benzyl group is particularly preferable.

It is particularly preferable for each of $R^{21}$ to $R^{23}$ and $R^{25}$ to $R^{27}$ to be independently an alkyl group or an aralkyl group. Of these, a methyl group, an ethyl group, a hexyl group, and a benzyl group are particularly preferable.

$R^{24}$ represents a bivalent connecting group, preferably an alkylene group, an aralkylene group, or an arylene group.

An alkylene group represented by $R^{24}$ preferably has not more than 8 carbon atoms, more preferably not more than 6 carbon atoms, particularly preferably not more than 4 carbon atoms. The alkylene group may be straight chain, or cyclic, and may have substituents, examples of the substituents including alkoxy groups, aryloxy groups, halogen atoms, a hydroxyl group, carbamoyl groups, and amino groups.

Specific examples of such (substituted) alkylene groups include a methylene group, an ethylene group, a propylene group, a trimethylene group, a tetramethylene group, a hexamethylene group, an octamethylene group, a 2-hydroxyethylene group, a 2-hydroxypropylene group, and a 2-methoxypropylene group.

Of these (substituted) alkylene groups, a methylene group, an ethylene group, a propylene group, a trimethylene group, and a 2-hydroxypropylene group are preferable.

An arylene group represented by $R^{24}$ preferably has not more than 12 carbon atoms, more preferably not more than 10 carbon atoms, particularly preferably not more than 8 carbon atoms. The arylene group may have substituents, examples of the substituents being as given above for the aryl group.

Specific examples of such (substituted) arylene groups include a phenylene group, alkylphenylene groups (e.g. a 2-ethyl-1,4-phenylene group, a 2-propyl-1,4-phenylene group, etc.), a 2-chloro-1,4-phenylene group, and alkoxyphenylene groups (e.g. a 2-methoxy-1,4-phenylene group, etc.). Of these, a phenylene group is particularly preferable.

An aralkylene group represented by $R^{24}$ preferably has not more than 12 carbon atoms, more preferably not more than 10 carbon atoms, particularly preferably not more than 8 carbon atoms. Examples of the alkyl part of the aralkylene group are alkyl group as above, and examples of the aryl part of the aralkylene group are aryl groups as above. The aralkylene group may have substituents, examples of the substituents being as given above for the alkyl group and the aryl group.

Specific examples of such (substituted) aralkylene groups include a xylylene group and a benzylidene group, with a benzylidene group being particularly preferable.

It is particularly preferable for $R^{24}$ to be alkylene group, with an ethylene group or a propylene group being more preferable.

As an alkyl group represented by R', those given above as alkyl groups for $R^{21}$ to $R^{23}$ and $R^{25}$ to $R^{27}$ are preferable. Preferable specific examples are also as for $R^{21}$ to $R^{23}$ and $R^{25}$ to $R^{27}$.

"—Y—" is particularly preferably "—O—" or "—NH—".

$X^-$ is a counter anion, examples including a halide ion ($Cl^-$, $Br^-$, $I^-$), a sulfonate ion, alkylsulfonate ions, arylsulfonate ions, alkylcarboxylate ions, arylcarboxylate ions, $PF_6^-$, and $BF_4^-$. Of these, $Cl^-$, $Br^-$, a toluenesulfonate ion, a methanesulfonate ion, $PF_6^-$, and $BF_4^-$ are particularly preferable.

In the case of a polymer having therein a unit represented by general formula (2) or (3), the content of the unit represented by general formula (2) or (3) in the polymer is preferably in a range of 10 to 100 mol %, more preferably 20 to 100 mol %.

Preferable specific examples of polymers having units represented by general formula (2) or (3) are as follows.

P2-1

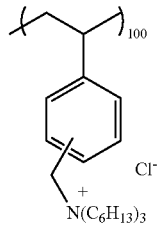

P2-2

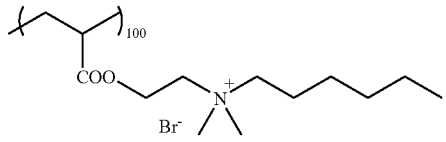

P2-3

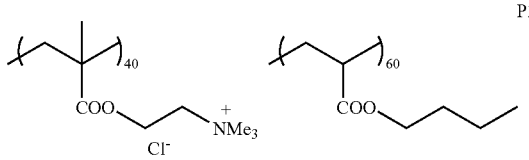

P2-4

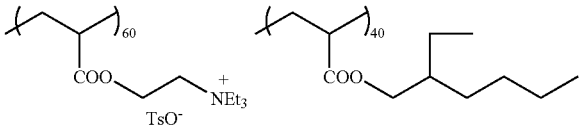

P2-5

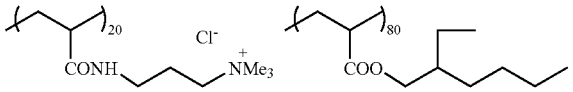

P2-6

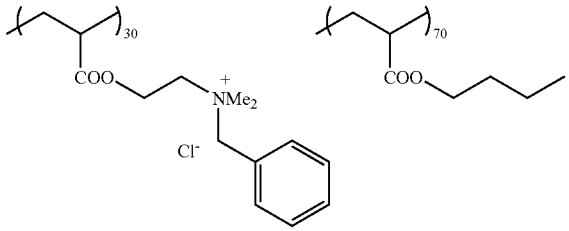

P2-7

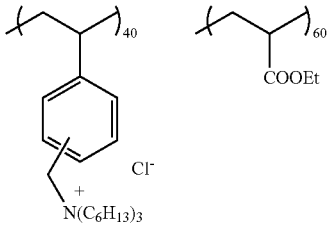

P2-8

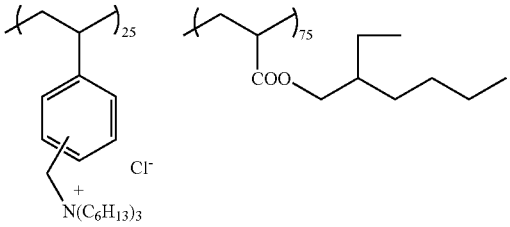

-continued

P2-9

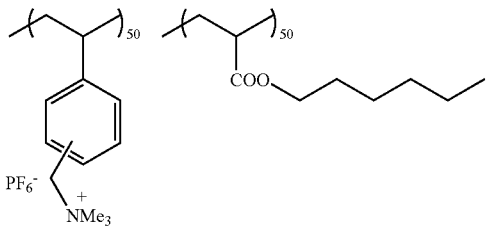

P2-10

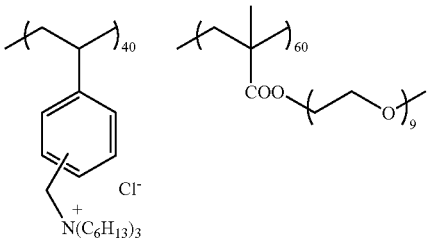

P2-11

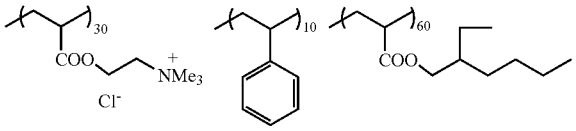

P2-12

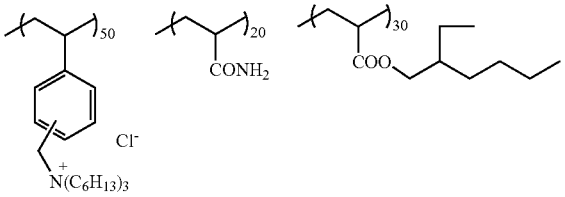

P2-13

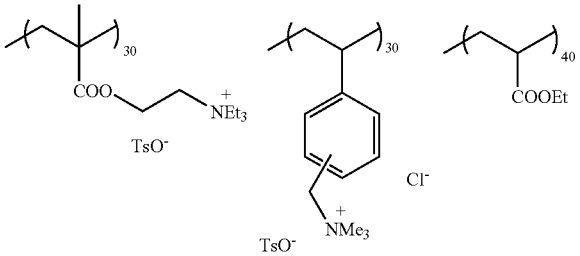

Examples of polymers having an onium group according to the present invention other than polymers having units represented by general formula (2) or (3) include epichlorohydrin-dimethylamine addition polymers, and addition polymers between a dihalide compound (e.g. xylylene dichloride, xylylene dibromide, 1,6-dibromohexane) and a diamine (N,N,N',N'-tetramethylethylenediamine, N,N,N',N'-tetramethylhexamethylenediamine, N,N'-dimethylpiperazine, diazobicyclooctane).

A polymer having an amino group (e.g. polyallylamine, polyvinylamine, polyethyleneimine, polydiallylamine, poly(N-methyldiallylamine), poly(N-ethyldiallylamine), a polyadduct between a diisocyanate (e.g. hexamethylene diisocyanate, isophorone diisocyanate, toluene diisocyanate, xylylene diisocyanate) and a diol having a tertiary amino group (e.g. N-methyldiethanolamine, N-ethyldiethanolamine, N,N'-3-hydroxypropylpiperazine), etc.) can also be obtained by adding methyl chloride, ethyl chloride, methyl bromide, ethyl bromide, methyl iodide, ethyl iodide, dimethyl sulfate, diethyl sulfate, methyl p-toluenesulfonate, or ethyl p-toluenesulfonate.

Of these, specific examples of preferable polymers are as follows.

P2-14

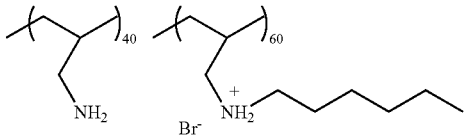

P2-15

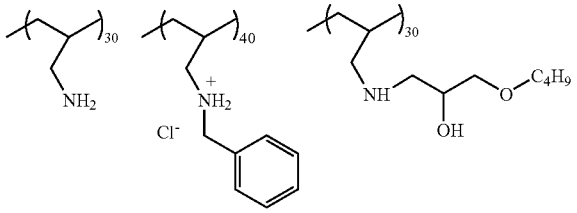

P2-16

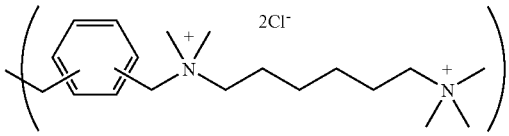

P2-17

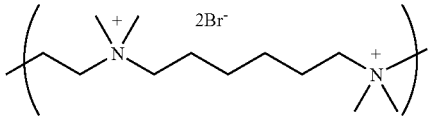

A polymer having a unit represented by general formula (2) or (3) can be obtained as a homopolymer of an undermentioned monomer having an ammonium group or a copolymer containing such a monomer.

Examples of the monomer having an ammonium group include trimethyl-p-vinylbenzyl ammonium chloride, trimethyl-m-vinylbenzyl ammonium chloride, triethyl-p-vinylbenzyl ammonium chloride, triethyl-m-vinylbenzyl ammonium chloride, N,N-dimethyl-N-ethyl-N-p-vinylbenzyl ammonium chloride, N,N-diethyl-N-methyl-N-p-vinylbenzyl ammonium chloride, N,N-dimethyl-N-n-propyl-N-p-vinylbenzyl ammonium chloride, N,N-dimethyl-N-n-octyl-N-p-vinylbenzyl ammonium chloride, N,N-dimethyl-N-benzyl-N-p-vinylbenzyl ammonium chloride, N,N-diethyl-N-benzyl-N-p-vinylbenzyl ammonium chloride, N,N-dimethyl-N-(4-methyl)benzyl-N-p-vinylbenzyl ammonium chloride, N,N-dimethyl-N-phenyl-N-p-vinylbenzyl ammonium chloride, trimethyl-p-vinylbenzyl ammonium bromide, trimethyl-m-vinylbenzyl ammonium bromide, trimethyl-p-vinylbenzyl ammonium sulfonate, trimethyl-m-vinylbenzyl ammonium sulfonate, trimethyl-p-vinylbenzyl ammonium acetate, trimethyl-m-vinylbenzyl ammonium acetate, N,N,N-triethyl-N-2-(4-vinylphenyl)ethyl ammonium chloride, N,N,N-triethyl-N-2-(3-vinylphenyl)ethyl ammonium chloride, N,N-diethyl-N-methyl-N-2-(4-vinylphenyl)ethyl ammonium chloride, N,N-diethyl-N-methyl-N-2-(4-vinylphenyl)ethyl ammonium acetate, trimethyl-2-(methacryloyloxy)ethyl ammonium chloride, triethyl-2-(methacryloyloxy)ethyl ammonium chloride, trimethyl-2-(acryloyloxy)

ethyl ammonium chloride, triethyl-2-(acryloyloxy)ethyl ammonium chloride, trimethyl-3-(methacryloyloxy)propyl ammonium chloride, triethyl-3-(methacryloyloxy)propyl ammonium chloride, trimethyl-2-(methacryloylamino)ethyl ammonium chloride, triethyl-2-(methacryloylamino)ethyl ammonium chloride, trimethyl-2-(acryloylamino)ethyl ammonium chloride, triethyl-2-(acryloylamino)ethyl ammonium chloride, trimethyl-3-(methacryloylamino)propyl ammonium chloride, triethyl-3-(methacryloylamino)propyl ammonium chloride, trimethyl-3-(acryloylamino)propyl ammonium chloride, triethyl-3-(acryloylamino)propyl ammonium chloride, N,N-dimethyl-N-ethyl-2-(methacryloyloxy)ethyl ammonium chloride, N,N-diethyl-N-methyl-2-(methacryloyloxy)ethyl ammonium chloride, N,N-dimethyl-N-ethyl-3-(acryloylamino)propyl ammonium chloride, trimethyl-2-(methacryloyloxy)ethyl ammonium bromide, trimethyl-3-(acryloylamino)propyl ammonium bromide, trimethyl-2-(methacryloyloxy)ethyl ammonium sulfonate, trimethyl-3-(acryloylamino)propyl ammonium acetate, monomethyldiallyl ammonium chloride, dimethyldiallyl ammonium chloride, and allylamine hydrochloride.

Examples of monomers that can be copolymerized with these monomers include (meth)acrylic acid alkyl esters (e.g. C1-18 alkyl esters of (meth)acrylic acid such as methyl(meth) acrylate, ethyl(meth)acrylate, propyl(meth)acrylate, isopropyl(meth)acrylate, n-butyl(meth)acrylate, isobutyl(meth) acrylate, t-butyl(meth)acrylate, hexyl(meth)acrylate, octyl (meth)acrylate, 2-ethylhexyl(meth)acrylate, lauryl(meth) acrylate, and stearyl(meth)acrylate), (meth)acrylic acid cycloalkyl esters (e.g. cyclohexyl(meth)acrylate, etc.), (meth)acrylic acid aryl esters (e.g. phenyl(meth)acrylate, etc.), aralkyl esters (e.g. benzyl(meth)acrylate, etc.), substituted (meth)acrylic acid alkyl esters (e.g. 2-hydroxyethyl (meth)acrylate, etc.), (meth)acrylamides (e.g. (meth)acrylamide, dimethyl(meth)acrylamide, etc.), aromatic vinyl compounds (e.g. styrene, vinyltoluene, α-methylstyrene, etc.), vinyl esters (e.g. vinyl acetate, vinyl propionate, vinyl versatate, etc.), allyl esters (e.g. allyl acetate, etc.), halogen-containing monomers (e.g. vinylidene chloride, vinyl chloride, etc.), vinyl cyanides (e.g. (meth)acrylonitrile, etc.), and olefins (e.g. ethylene, propylene, etc.).

Of these copolymerizable monomers, (meth)acrylic acid alkyl esters, (meth)acrylamides, and aromatic vinyl compounds are preferable, with methyl(meth)acrylate, ethyl (meth)acrylate, propyl(meth)acrylate, isopropyl(meth)acrylate, n-butyl(meth)acrylate, isobutyl(meth)acrylate, t-butyl (meth)acrylate, hexyl(meth)acrylate, octyl(meth)acrylate, 2-ethylhexyl(meth)acrylate, 2-hydroxyethyl(meth)acrylate, and styrene being particularly preferable.

A polymer as above can be synthesized through radical (co)polymerization of the monomer(s). As the radical polymerization, a publicly known method such as bulk polymerization, solution polymerization, or emulsion polymerization can be used. Moreover, a polymerization initiating catalyst well known to persons skilled in the art can be used as required.

The weight average molecular weight of a polymer having an onium group used in the present invention is preferably not less than 1000 but not more than 50000, particularly preferably not less than 2000 but not more than 30000.

The amount used of the polymer having an onium group in the present invention is preferably in a range of 1 to 90% by mass, more preferably 10 to 75% by mass, particularly preferably 20 to 50% by mass, relative to all of each liquid. If the amount used is less than this, then it may not be possible to achieve the effects of the present invention effectively, whereas if the amount used is greater than this, then the viscosity may become high, and hence problems with the ink ejectability may arise.

Polymers Having a Nitrogen-containing Hetero Ring

A polymer having a nitrogen-containing hetero ring may be a homopolymer of only a monomer having a nitrogen-containing hetero ring, or a copolymer of a monomer having a nitrogen-containing hetero ring and another monomer. The "monomer having a nitrogen-containing hetero ring" content in the polymer having a nitrogen-containing hetero ring is preferably at least 10 mol %, more preferably at least 20 mol %.

Here, specific examples of the nitrogen-containing hetero ring include saturated hetero rings (e.g. aziridine, azetidine, pyrrolidone, piperidine, piperazine, morpholine, thiomorpholine, caprolactam, valerolactam), and unsaturated hetero rings (e.g. imidazole, pyridine, pyrrole, pyrazole, pyrazine, pyrimidine, indole, purine, quinoline, triazine, etc.).

These nitrogen-containing hetero rings may further have substituents, examples of the substituents including alkyl groups, aryl groups, alkoxy groups, aryloxy groups, halogen atoms, a hydroxyl group, carbamoyl groups, and amino groups.

A polymer used in the present invention is preferably a polymer obtained from a vinyl monomer having such a nitrogen-containing hetero ring. Specific examples include N-vinylpyrrolidone, N-vinylcaprolactam, acryloylmorpholine, acryloylthiomorpholine, N-vinylimidazole, 2-methyl-1-vinylimidazole, 2-vinylpyridine, 4-vinylpyridine, N-vinylcarbazole, N-methylmaleimide, N-ethylmaleimide, and 2-isopropenyl-2-oxazoline. Of these, N-vinylimidazole, 2-vinylpyridine, and 4-vinylpyridine are particularly preferable.

Furthermore, a polymer used in the present invention may be a copolymer between such a monomer and a monomer that can be copolymerized therewith. Examples of copolymerizable monomers include (meth)acrylic acid alkyl esters (e.g. C1-18 alkyl esters of (meth)acrylic acid such as methyl(meth) acrylate, ethyl(meth)acrylate, propyl(meth)acrylate, isopropyl(meth)acrylate, n-butyl(meth)acrylate, isobutyl(meth) acrylate, t-butyl(meth)acrylate, hexyl(meth)acrylate, octyl (meth)acrylate, 2-ethylhexyl(meth)acrylate, lauryl(meth) acrylate, and stearyl(meth)acrylate, etc.), (meth)acrylic acid cycloalkyl esters (e.g. cyclohexyl(meth)acrylate, etc.), (meth)acrylic acid aryl esters (e.g. phenyl(meth)acrylate, etc.), aralkyl esters (e.g. benzyl(meth)acrylate, etc.), substituted (meth)acrylic acid alkyl esters (e.g. 2-hydroxyethyl (meth)acrylate, etc.), (meth)acrylamides (e.g. (meth)acrylamide, dimethyl(meth)acrylamide, etc.), aromatic vinyl compounds (e.g. styrene, vinyltoluene, α-methylstyrene, etc.), vinyl esters (e.g. vinyl acetate, vinyl propionate, vinyl versatate, etc.), allyl esters (e.g. allyl acetate, etc.), halogen-containing monomers (e.g. vinylidene chloride, vinyl chloride, etc.), vinyl cyanides (e.g. (meth)acrylonitrile, etc.), and olefins (e.g. ethylene, propylene, etc.).

Of these copolymerizable monomers, (meth)acrylic acid alkyl esters, (meth)acrylamides, and aromatic vinyl compounds are preferable, with methyl(meth)acrylate, ethyl (meth)acrylate, propyl(meth)acrylate, isopropyl(meth)acrylate, n-butyl(meth)acrylate, isobutyl(meth)acrylate, t-butyl (meth)acrylate, hexyl(meth)acrylate, octyl(meth)acrylate, 2-ethylhexyl(meth)acrylate, 2-hydroxyethyl(meth)acrylate, and styrene being particularly preferable.

The "monomer having a nitrogen-containing hetero ring" content in the polymer having a nitrogen-containing hetero ring is preferably not less than 10 but not more than 100 mol %, more preferably not less than 20 but not more than 100 mol %.

A polymer as above can be synthesized through radical (co)polymerization of the 20 monomer(s). As the radical polymerization, a publicly known method such as bulk polymerization, solution polymerization, or emulsion polymerization can be used. Moreover, a polymerization initiating catalyst well known to persons skilled in the art can be used as required.

Furthermore, a polymer used in the present invention may be obtained by polycondensation. Examples include polymers obtained through polycondensation between a 2,4-dichlorotriazine (e.g. 2,4-dichloro-6-butylamino-1,3,5-triazine) and a diamine (e.g. N,N'-dimethylethylenediamine, N,N'-dimethylhexamethylenediamine, N,N'-dibutylhexamethylenediamine, N,N'-dioctylhexamethylenediamine, etc.), and polymers obtained through polycondensation between a piperazine and a dicarboxylic acid (e.g. adipic acid) ester.

Preferable specific examples of polymers having a nitrogen-containing hetero ring are as follows.

P3-1

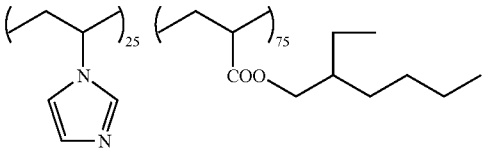

P3-2

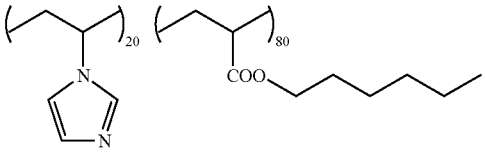

P3-3

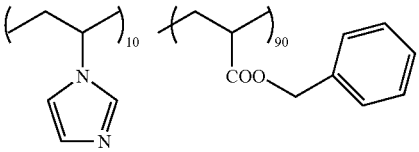

P3-4

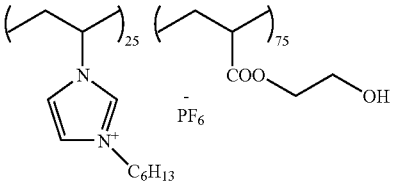

P3-5

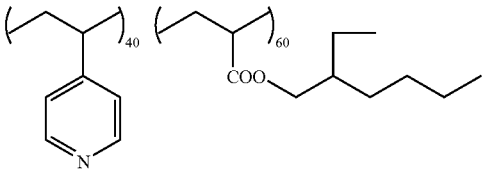

-continued

P3-6

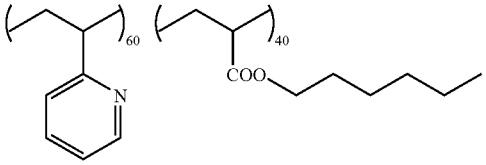

P3-7

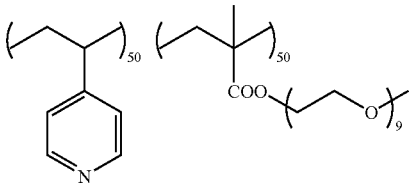

P3-8

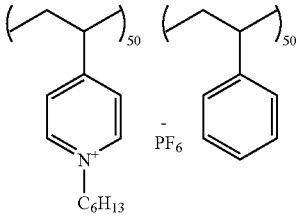

P3-9

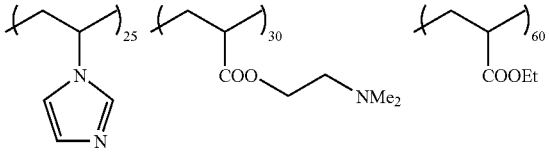

P3-10

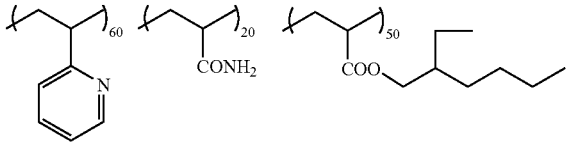

P3-11

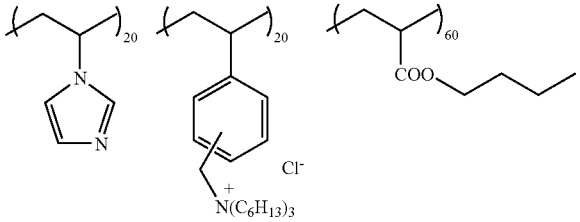

P3-12

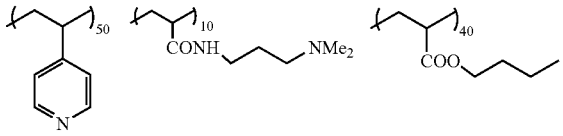

Furthermore, the following polymers are also preferable specific examples.

P3-13

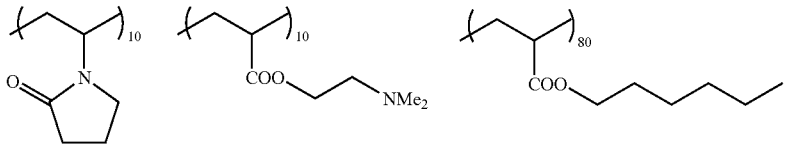

P3-14

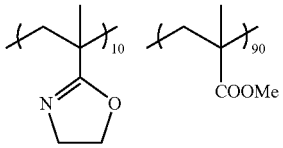

P3-15

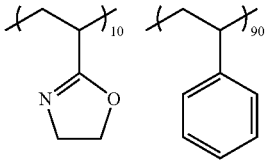

P3-16

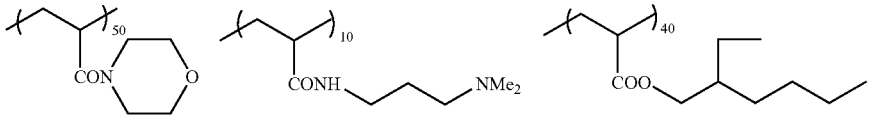

P3-17

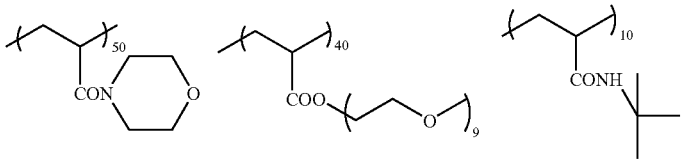

P3-18

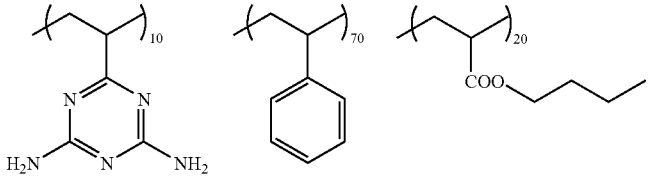

P3-19

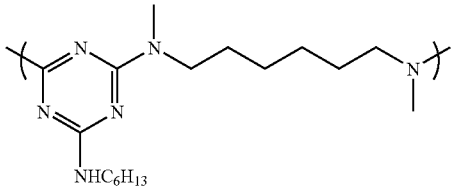

P3-20

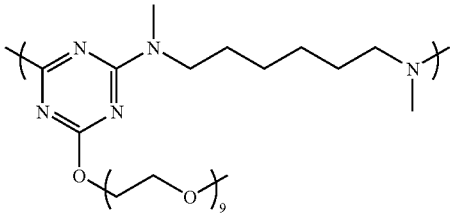

P3-21

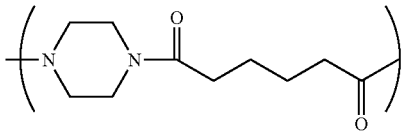

P3-22

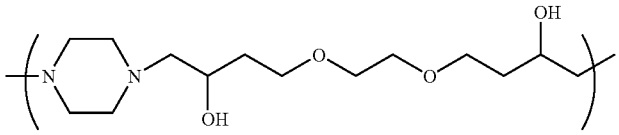

The weight average molecular weight of a polymer having a nitrogen-containing hetero ring used in the present invention is preferably not less than 1000 but not more than 50000, particularly preferably not less than 2000 but not more than 30000.

The amount used of the polymer having a nitrogen-containing hetero ring in the present invention is preferably in a range of 1 to 90% by mass, more preferably 10 to 75% by mass, particularly preferably 20 to 50% by mass, relative to all of each liquid. If the amount used is less than this, then it may not be possible to achieve the effects of the present invention effectively, whereas if the amount used is greater than this, then the viscosity may become high, and hence problems with the ink ejectability may arise.

Metal Compounds

Examples of metal compounds are metal salts of aliphatic carboxylic acids (e.g. acetic acid, propionic acid, butyric acid, valeric acid, isovaleric acid, pivalic acid, lauric acid, myristic acid, palmitic acid, stearic acid, 2-ethylhexanoic acid, lactic acid, pyruvic acid, etc.), metal salts of aromatic carboxylic acids (e.g. benzoic acid, salicylic acid, phthalic acid, cinnamic acid, etc.), metal salts of aliphatic sulfonic acids (e.g. methanesulfonic acid, ethanesulfonic acid, propanesulfonic acid, hexanesulfonic acid, 2-ethylhexanesulfonic acid, etc.), and metal salts of aromatic sulfonic acids (benzenesulfonic acid, naphthalenesulfonic acid, etc.), and also 1,3-diketone metal compounds. Of these, metal salts of aliphatic carboxylic acids, and 1,3-diketone metal compounds are preferable.

An aliphatic carboxylic acid as above may be straight chain, branched, or cyclic, and preferably has 2 to 40 carbon atoms, more preferably 6 to 25 carbon atoms. Moreover, the aliphatic carboxylic acid may have substituents, examples of the substituents including aryl groups, alkoxy groups, aryloxy groups, halogen atoms, a hydroxyl group, carbamoyl groups, amino groups, and a carboxy group.

Preferable examples of aryl groups as substituents include a phenyl group, alkylphenyl groups (e.g. a methylphenyl group, an ethylphenyl group, an n-propylphenyl group, an n-butylphenyl group, a cumenyl group, a mesityl group, a tolyl group, a xylyl group), a naphthyl group, a chlorophenyl group, a dichlorophenyl group, a trichlorophenyl group, a bromophenyl group, a hydroxyphenyl group, a methoxyphenyl group, an acetoxyphenyl group, and a cyanophenyl group, with a phenyl group and a naphthyl group being more preferable.

Preferable examples of alkoxy groups as substituents are a methoxy group, an ethoxy group, a propoxy group, an isopropoxy group, a butoxy group, a t-butoxy group, a hexyloxy group, a cyclohexyloxy group, a 2-ethylhexyloxy group, an octyloxy group, and a dodecyloxy group, with a methoxy group, an ethoxy group, a propoxy group, an isopropoxy group, a butoxy group, and a t-butoxy group being more preferable.

Preferable examples of aryloxy groups as substituents are a phenoxy group, a methylphenoxy group, an ethylphenoxy group, a cumenyloxy group, a tolyloxy group, a xylyloxy group, a naphthyloxy group, a chlorophenoxy group, a hydroxyphenoxy group, a methoxyphenoxy group, and an acetoxyphenoxy group, with a phenoxy group being more preferable.

Examples of halogen atoms as substituents are a fluorine atom, a chlorine atom, a bromine atom, and an iodine atom.

Preferable examples of carbamoyl groups as substituents are carbamoyl groups, alkylcarbamoyl groups (e.g. a methylcarbamoyl group, an ethylcarbamoyl group, a propylcarbamoyl group, a butylcarbamoyl group, etc.), and arylcarbamoyl groups (e.g. a phenylcarbamoyl group), with a carbamoyl group, a methylcarbamoyl group, and an ethylcarbamoyl group being more preferable.

Preferable examples of amino groups as substituents are a primary amino group, N-substituted amino groups (e.g. an N-methylamino group, an N-ethylamino group, an N-propylamino group, an N-butylamino group, an N-hexylamino group, an N-octylamino group, an N-benzylamino group), and N,N-disubstituted amino groups (e.g. an N,N-dimethylamino group, an N,N-diethylamino group, an N-methyl-N-ethylamino group, an N,N-dibutylamino group, an N-ethyl-N-octylamino group, an N-methyl-N-benzyl amino group), with an N-methylamino group, an N-ethylamino group, an N,N-dimethylamino group, an N,N-diethylamino group, and an N-methyl-N-ethylamino group being more preferable.

Particularly preferable aliphatic carboxylic acids are n-hexanoic acid, 2-ethylhexanoic acid, n-octanoic acid, lauric acid, myristic acid, palmitic acid, stearic acid, and 2-ethylhexanoic acid. Ethylenediaminetetraacetic acid is also a preferable example.

A 1,3-diketone as above may be may be straight chain, branched, or cyclic, and preferably has 5 to 40 carbon atoms, more preferably 5 to 25 carbon atoms. Examples include 2,4-pentadione, 3,5-heptadione, 2,2,6,6-tetramethylheptadione, 4,6-nonadione, 7,9-pentadecadione, 2,4-dimethyl-7,9-pentadecadione, 2-acetylcyclopentanone, 2-acetylcyclohexanone, 3-methyl-2,4-pentadione, 3-(2-ethylhexyl)2,4-pentadione, and 3-[4-(2-ethylhexyloxy)benzyl]-2,4-pentadione, with 2,4-pentadione, 7,9-pentadecadione, and 3-[4-(2-ethylhexyloxy)benzyl]-2,4-pentadione being preferable.

These groups may further have substituents, examples of the substituents including aryl groups, alkoxy groups, aryloxy groups, halogen atoms, a hydroxyl group, carbamoyl groups, amino groups, and a carboxy group. More preferable aryl groups, alkoxy groups, aryloxy groups, halogen atoms, hydroxyl groups, carbamoyl groups, and amino groups as substituents are as in the case of an aliphatic carboxylic acid described above.

An example of the metal in the metal compound is one selected from the group of zinc, aluminum, calcium, magnesium, iron, cobalt, nickel, and copper. Of these, zinc, aluminum, and nickel are preferable, with zinc being particularly preferable.

Preferable metal salts of aliphatic carboxylic acids in the present invention are as follows.

1-1

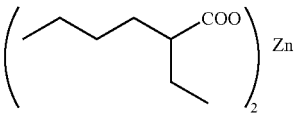

1-2

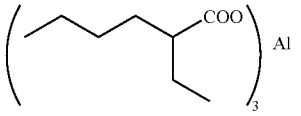

1-3

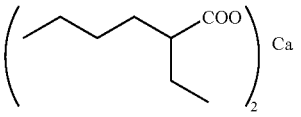

1-4

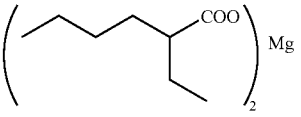

1-5

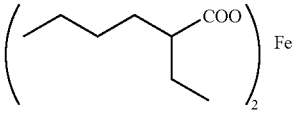

1-6

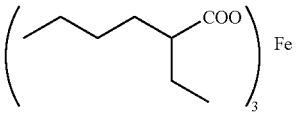

-continued 1-7

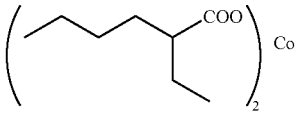

1-8

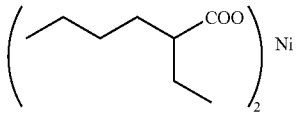

1-9

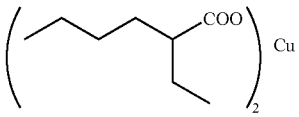

1-10

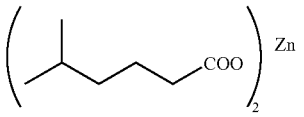

1-11

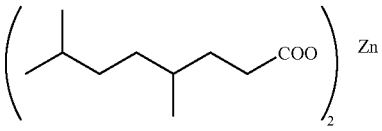

1-12

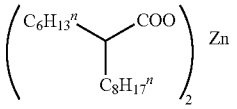

1-13

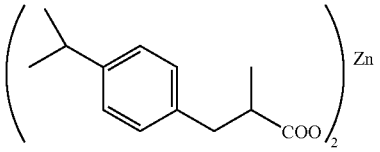

1-14

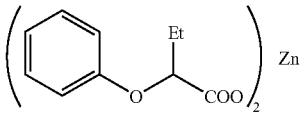

1-15

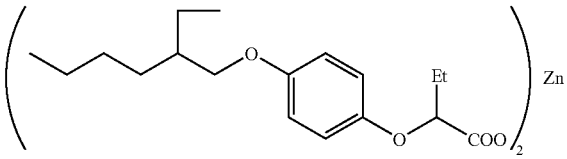

1-16

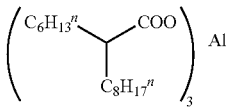

Furthermore, preferable specific examples of 1,3-diketone metal compounds in the present invention are as follows.

2-1

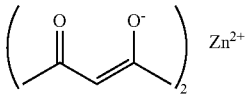

2-2

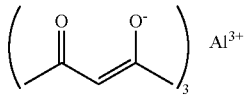

2-3

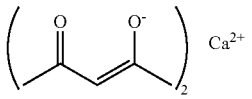

2-4

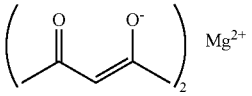

2-5

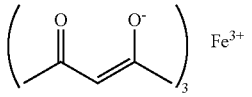

2-6

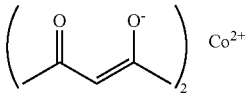

2-7

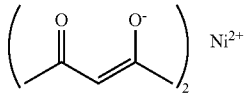

2-8

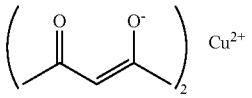

2-9

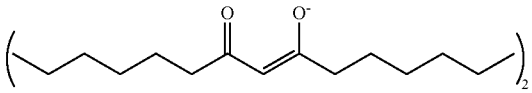

2-10

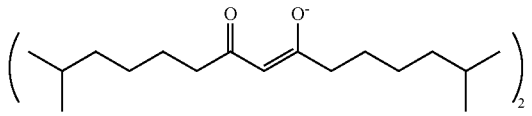

2-11

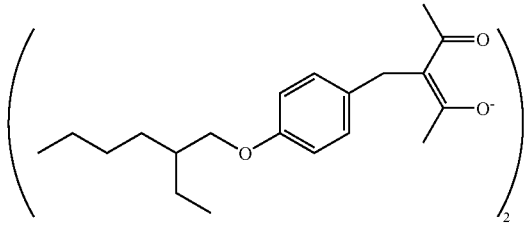

A metal salt of an aliphatic carboxylic acid or a 1,3-diketone metal compound as above can be synthesized through complexation in a solution. Alternatively, there is no limitation to this, but rather another publicly known method may be used.

The amount used of the metal compound in the present invention is preferably in a range of 1 to 90% by mass, more preferably 10 to 75% by mass, particularly preferably 20 to 50% by mass, relative to all of each liquid. If the amount used is less than this, then it may not be possible to achieve the effects of the present invention effectively, whereas if the amount used is greater than this, then the viscosity may become high, and hence problems with the ink ejectability may arise.

High-boiling Organic Solvents (Oils)

In the present invention, "high-boiling organic solvent" refers to an organic solvent that has a viscosity at 25° C. of not more than 100 mPa·s or a viscosity at 60° C. of not more than 30 mPa·s, and has a boiling point higher than 100° C.

Here, "viscosity" in the present invention refers to the viscosity obtained using a RE80 viscometer made by Toki Sangyo Co., Ltd. The RE80 viscometer is a conical rotor/flat plate type viscometer corresponding to the E type, and measurement is carried out using a rotor code No. 1 rotor at a rotational speed of 10 rpm. Note, however, that in the case of a viscosity higher than 60 mPa·s, measurement is carried out with the rotational speed changed to 5 rpm, 2.5 rpm, 1 rpm, 0.5 rpm, or the like as required.

Moreover, "solubility of water" in the present invention means the saturated concentration of water in the high-boiling organic solvent at 25° C., this being the mass (g) of water that can be dissolved in 100 g of the high-boiling organic solvent at 25° C.

The amount used of the high-boiling organic solvent is preferably 5 to 2000% by mass, more preferably 10 to 1000% by mass, in terms of the consumed amount relative to the colorant used.

In the present invention, various compounds are preferable as the high-boiling organic solvent.

Storage Stabilizer

In the present invention, a storage stabilizer may be added to each of the plurality of liquids with an object of suppressing undesirable polymerization during storage of the liquid. The storage stabilizer is preferably used in each of the liquids having the polymerizable compound(s) therein. Moreover, it is preferable to use a storage stabilizer that is soluble in the liquid or other coexisting components.

Examples of the storage stabilizer include quaternary ammonium salts, hydroxyamines, cyclic amides, nitrile compounds, substituted ureas, heterocyclic compounds, organic acids, hydroquinones, hydroquinone monoethers, organic phosphines, and copper compounds.

The amount added of the storage stabilizer is preferably adjusted as appropriate on the basis of the activity of the polymerization initiator used, the polymerizability of the polymerizable compound(s), and the type of the storage stabilizer. From the viewpoint of balance between the storage stability and the curability of the ink upon mixing the liquids, the amount added of the storage stabilizer is preferably 0.005 to 1% by mass, more preferably 0.01 to 0.5% by mass, yet more preferably 0.01 to 0.2% by mass, in terms of solid content in the liquid.

Energy Applying Process

For an exposing light source for promoting polymerization of the polymerizable compound(s) in the present invention, ultraviolet radiation or visible light may be used. Moreover, the application of energy may be carried out using radiation other than light, such as α-rays, γ-rays, X-rays, or an electron beam; however, from the viewpoints of cost and safety, it is preferable to use ultraviolet radiation or visible light, with it being more preferable to use ultraviolet radiation. The amount of energy required for the curing reaction varies depending on the type and content of the polymerization initiator, and is generally approximately 1 to 500 mJ/cm$^2$.

Description of Curing Energy

In the inkjet recording apparatus 10 shown in the present example, from the viewpoint of obtaining excellent fixation, there is a process of fixing the image on the recording paper 16 by applying energy after the image has been formed.

That is, by applying energy to the treatment liquid and the colored inks that have been deposited onto the recording paper 16, polymerization and curing of these liquids is promoted, whereby a firmer image can be formed more efficiently. In the present example, the application of energy is carried out by performing irradiation of radiation such as UV.

That is, by applying energy (UV) using the preliminary curing light sources 34 and the main curing light source 36, generation of active species by decomposition of the polymerization initiator in the liquids that have been deposited on the recording paper 16 is promoted; and moreover by increasing the amount of the active species or increasing the temperature, polymerization and curing of the polymerizable compound(s) by the active species is promoted.

In the present example, one example of an exposing light source for promoting the polymerization of the polymerizable compound(s) has been given as being an ultraviolet radiation light source, but other than this, the application of energy may be carried out by performing irradiation of visible light, α-rays, γ-rays, X-rays, an electron beam, or the like. Of these, from the viewpoints of cost and safety, it is preferable to use ultraviolet radiation or visible light, with it being more preferable to use ultraviolet radiation. The amount of energy required for the curing reaction varies depending on the type and content of the polymerization initiator, and is generally approximately 1 to 500 mJ/cm$^2$.

Examples of the preliminary curing light sources 34 and the main curing light source 36 used in the inkjet recording apparatus 10 in the present example include metal halide lamps, xenon lamps, high-pressure mercury lamps, low-pressure mercury lamps, carbon arc lamps, sterilizing lamps, UV fluorescent lamps, and UV LEDs. The preliminary curing light sources 34 need merely be such as to be able to carry out the preliminary curing of the colored inks. Hence, the preliminary curing light sources 34 may perform the irradiation with a lower amount of energy per unit time (per unit area) than that of the irradiation by the main curing light source 36. Smaller light sources (in terms of both irradiation energy and size) may thus be used for the preliminary curing light sources 34 than for the main curing light source 36. An example is a mode in which UV fluorescent lamps or UV LEDs are used as the preliminary curing light sources 34, and a metal halide lamp is used as the main curing light source 36.

The peak wavelength of the radiation (in the present example, ultraviolet radiation) radiated from the preliminary curing light sources 34 is preferably shorter than that of the main curing light source 36. For example, it is preferable for the preliminary curing light sources 34 to have a peak wavelength in a range of 250 to 380 nm, and for the main curing light source 36 to have a peak wavelength in a range of 350 to 450 nm. By making the peak wavelength for the preliminary curing light sources 34 be shorter than that for the main curing light source 36 in this way, it is possible to put the dots formed from the colored inks into a half-cured state using the preliminary curing light sources 34, and then reliably put the dots into a cured state using the main curing light source 36. Note that the preliminary curing light sources 34 and the main curing light source 36 may instead have different wavelength distributions rather than different peak wavelengths.

Description of Recording Medium

In the present invention, either an ink-permeable recording medium, or a non-ink-permeable recording medium may be used. Examples of ink-permeable recording media include plain paper, inkjet-specific paper, coated paper, multi-use paper compatible with inkjet and electrophotography, a cloth, a nonwoven cloth, a porous film, and a polymeric absorbent. These are described as "member on which recording is carried out" in Japanese Patent Application Publication No. 2001-181549 etc.

The excellent effects of the present invention are remarkable with a non-ink-permeable recording medium. Examples of non-ink-permeable recording media include art paper, synthetic resins, rubber, resin-coated paper, glass, metal, ceramics, and wood. In addition, to add functionality, a composite substrate in which a plurality of these materials are combined may be used.

As a synthetic resin, any synthetic resin may be used. Examples include polyesters such as polyethylene terephthalate and polybutadiene terephthalate, polyvinyl chloride, polystyrene, polyethylene, polyurethanes, polyolefins such as polypropylene, acrylic resins, polycarbonates, acrylonitrile-butadiene-styrene copolymers and so on, diacetates, triacetates, polyimides, cellophane, and celluloid. There are no limitations on the thickness or shape of the synthetic resin substrate, which may be a film, a card, or a block. Moreover, the synthetic resin may be transparent or opaque.

As the mode of use of the synthetic resin, use in the form of a film used in so-called flexible packaging is also preferable, it being possible to use a film of any of various non-absorbent plastics, examples of the various plastic films including a PET film, an OPS film, an OPP film, a PNy film, a PVC film, a PE film, and a TAC film. As other plastics, a polycarbonate, an acrylic resin, ABS, polyacetal, PVA, rubber, or the like can be used.

Examples of resin-coated paper include a paper support laminated with a polyolefin resin on both surfaces of the paper, or a transparent polyester film, an opaque polyester film, or an opaque polyolefin resin film. Particularly preferable is a paper support laminated with a polyolefin resin on both surfaces of the paper.

As a metal, any metal can be used, it being preferable to use aluminum, iron, gold, silver, copper, nickel, titanium, chromium, molybdenum, silicon, lead, zinc, or the like, or a composite material thereof such as stainless steel.

Moreover, as the recording medium used in the present invention, it is also possible to use a read only optical disk such as a CD-ROM or a DVD-ROM, a write once type optical disk such as a CD-R or a DVD-R, or a rewritable optical disk, an ink-receiving layer and a luster-conferring layer being applied onto the label surface side thereof.

Other Embodiment

Figure 7:
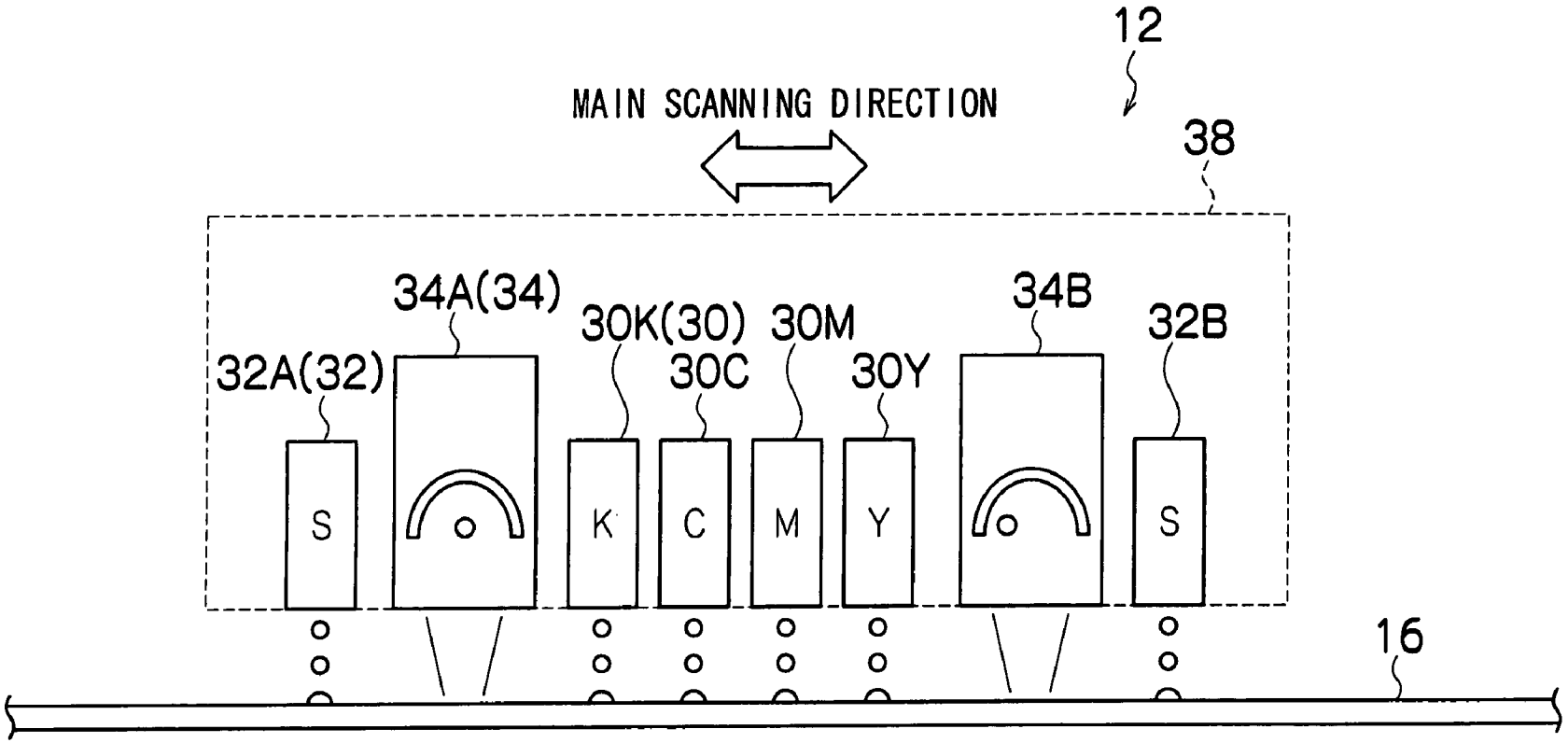
FIG. 7 is a front view of principal components showing another embodiment of the inkjet recording apparatus.

FIG. 7 is a front view of principal components showing another embodiment of the inkjet recording apparatus 10. In the present embodiment, the order in which the treatment liquid ejection heads 32 (32A, 32B) and the preliminary curing light sources 34 (34A, 34B) are arranged is the opposite to that in FIG. 6. That is, each preliminary curing light source 34 is disposed between the ink ejection heads 30 and each of the treatment liquid ejection heads 32. Other than this, the configuration is as shown in FIG. 6.

By disposing the treatment liquid ejection heads 32 on the outside in this way, the distance between the ink ejection heads 30 and each of the treatment liquid ejection heads 32 can be changed. For example, in the case where a recording medium for which the time taken for the treatment liquid to flatten is short is used, the treatment liquid ejection heads 32 are disposed as far as possible to the inside (the preliminary curing light source 34 side). In the case where this time is particularly short, it is desirable to dispose each treatment liquid ejection head between the ink ejection heads 30 and each of the preliminary curing light sources 34 as shown in FIG. 6. Conversely, in the case where a recording medium for which the time taken for the treatment liquid to flatten is long is used, it is preferable for the treatment liquid ejection heads 32 to be disposed away from the preliminary curing light sources 34. In this way, according to the present embodiment, the time from a treatment liquid ejection head 32 depositing the treatment liquid to the ink ejection heads 30 depositing the inks can be changed, and hence the problem that times until the treatment liquid flattens on the recording medium and irregularities become slight are different depending on the permeability of the recording medium, can be eliminated.

The image forming apparatus according to embodiments of the present invention has been described in detail above. The present invention is not limited to the above embodiments, and any of various modifications may be made within a scope such as not to deviate from the gist of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus comprising:

a first liquid ejection device which, while scanning to and fro in a direction substantially orthogonal to a conveyance direction of a recording medium, ejects a first liquid containing a coloring material onto the recording medium;

second liquid ejection devices which are disposed respectively on both regions in a scanning direction outside the first liquid ejection device, the second liquid ejection devices ejecting a second liquid not including a coloring material onto at least an area of the recording medium on which the first liquid is to be deposited prior to the first liquid being deposited while the second liquid ejection devices perform a scan together with the first liquid ejection device; and first radiation irradiating devices which are disposed respectively on both regions in the scanning direction outside the first liquid ejection device, the first radiation irradiating devices irradiating an area of the recording medium on which the first liquid and the second liquid have been deposited with a radiation while the first radiation irradiating devices perform a scan together with the first liquid ejection device, wherein one of the first liquid and the second liquid contains a radiation-curable polymerizable compound and does not contain a polymerization initiator; and the other of the first liquid and the second liquid contains the polymerization initiator and does not contain the radiation-curable polymerizable compound.

2. The image forming apparatus as defined in claim 1, wherein the second liquid contains a diffusion preventing agent for preventing diffusion and smearing of the first liquid.

3. The image forming apparatus as defined in claim 1, wherein the first liquid contains the radiation-curable polymerizable compound and does not contain the polymerization initiator; and the second liquid contains the polymerization initiator and does not contain the radiation-curable polymerizable compound.

4. The image forming apparatus as defined in claim 1, wherein the first liquid contains the polymerization initiator and does not contain the radiation-curable polymerizable compound; and the second liquid contains the radiation-curable polymerizable compound and does not contain the polymerization initiator.

5. The image forming apparatus as defined in claim 1, wherein the second liquid ejection devices are disposed between the first liquid ejection device and the first radiation irradiating devices.

6. The image forming apparatus as defined in claim 1, wherein the first radiation irradiating devices are disposed between the first liquid ejection device and the second liquid ejection devices.

7. The image forming apparatus as defined in claim 1, further comprising a second radiation irradiating device which is disposed after the first liquid ejection device in the conveyance direction of the recording medium, the second radiation irradiating device performing irradiation of a radiation over a length corresponding to a width of the recording medium.

8. The image forming apparatus as defined in claim 7, wherein wavelength distribution of the radiation by the first radiation irradiating devices is different from wavelength distribution of the radiation by the second radiation irradiating device.

9. The image forming apparatus as defined in claim 8, wherein a peak wavelength of the radiation by the first radiation irradiating devices is shorter than a peak wavelength of the radiation by the second radiation irradiating device.

* * * * *